US011062652B1

(12) United States Patent
Zhou et al.

(10) Patent No.: US 11,062,652 B1
(45) Date of Patent: Jul. 13, 2021

(54) PIXEL CIRCUIT, DRIVING METHOD THEREOF, DISPLAY PANEL AND DISPLAY DEVICE

(71) Applicant: Wuhan Tianma Micro-Electronics Co., Ltd., Wuhan (CN)

(72) Inventors: Maoqing Zhou, Wuhan (CN); Fei Chen, Wuhan (CN); Dongxu Xiang, Wuhan (CN)

(73) Assignee: WUHAN TIANMA MICRO-ELECTRONICS CO., LTD., Wuhan (CN)

( * ) Notice: Subject to any disclaimer, the term of this patent is extended or adjusted under 35 U.S.C. 154(b) by 0 days.

(21) Appl. No.: 16/860,254

(22) Filed: Apr. 28, 2020

(30) Foreign Application Priority Data

Jan. 2, 2020 (CN) ..... 202010001983.6

(51) Int. Cl.

| | |
|---|---|
| ***G09G 3/325*** | (2016.01) |
| ***G09G 3/36*** | (2006.01) |
| ***G09G 3/3291*** | (2016.01) |
| ***G09G 3/3266*** | (2016.01) |

(52) U.S. Cl.
CPC ..... *G09G 3/325* (2013.01); *G09G 3/3266* (2013.01); *G09G 3/3291* (2013.01); *G09G 3/3659* (2013.01)

(58) Field of Classification Search
CPC ..... G09G 3/3233; G09G 2300/0819; G09G 2320/0233; G09G 2320/045; G09G 3/325; G09G 3/3266; G09G 3/3659; G09G 3/3291
USPC ..... 345/76
See application file for complete search history.

(56) References Cited

U.S. PATENT DOCUMENTS

| | | | | |
|---|---|---|---|---|
| 2016/0180818 | A1* | 6/2016 | Kim | G09G 3/3233 345/213 |
| 2016/0247451 | A1* | 8/2016 | Kim | G09G 3/3233 |
| 2017/0103701 | A1* | 4/2017 | Zhu | G09G 3/3233 |
| 2017/0270853 | A1* | 9/2017 | Xiang | G09G 3/3275 |
| 2018/0301092 | A1* | 10/2018 | Ma | G09G 3/3233 |
| 2019/0114954 | A1* | 4/2019 | Xuan | G09G 3/3233 |

FOREIGN PATENT DOCUMENTS

| | | | |
|---|---|---|---|
| CN | 102842283 | A | 12/2014 |
| CN | 107731184 | A | 2/2018 |

* cited by examiner

*Primary Examiner* — Koosha Sharifi-Tafreshi
(74) *Attorney, Agent, or Firm* — Miller, Matthias & Hull LLP

(57) ABSTRACT

Disclosed are a pixel circuit, a driving method, a display panel and a display device. A data writing module of the pixel circuit supplies a data signal to a gate electrode of a drive transistor and a first plate of a storage capacitor in a data writing phase. A reset module of the pixel circuit supplies a reset signal to a second plate of the storage capacitor in a data writing phase. A threshold compensation module of the pixel circuit supplies a threshold compensation signal to the second plate of the storage capacitor in a threshold compensation phase, and accordingly a potential of the first plate of the storage capacitor is adjusted to a first potential, and the drive transistor is threshold compensated. The threshold compensation signal is greater than the reset signal. A drive transistor supplies a drive current to an organic light-emitting element in a light emission phase to drive the organic light-emitting element to emit light.

20 Claims, 15 Drawing Sheets

PIXEL CIRCUIT, DRIVING METHOD THEREOF, DISPLAY PANEL AND DISPLAY DEVICE

CROSS-REFERENCE TO RELATED APPLICATION

This application claims priority to Chinese patent application No. CN 202010001983.6 filed at CNIPA on Jan. 2, 2020, the disclosure of which is incorporated herein by reference in its entirety.

TECHNICAL FIELD

The present disclosure relates to the field of display technologies and, in particular, to a pixel circuit, a driving method thereof, a display panel and a display device.

BACKGROUND

Organic Light Emitting Diode (OLED) display has the advantages of self-emission, low driving voltage, high luminous efficiency, short response time, and capability of implementing flexible display, and thus is the most promising display at present.

An OLED element of the OLED display is a current-driven element, and needs a pixel drive circuit for providing a drive current, so that the OLED element can emit light. The pixel drive circuit of the OLED display generally includes a drive transistor, a switching transistor and a storage capacitor. The drive transistor can generate, in dependence on the voltage of the gate electrode of the drive transistor, a drive current to drive the OLED element. However, due to the effect of manufacturing process and device aging, the threshold voltage of the drive transistor in the pixel drive circuit is shifted, resulting in non-uniform display.

SUMMARY

Embodiments of the present disclosure provide a pixel circuit, a driving method thereof, a display panel and a display device to solve the technical problem that the gate electrode voltage of a drive transistor is changed due to the influence of a leakage current in the related art, which affects a luminescence of a light-emitting element, causes uneven display, and affects a display effect.

In one aspect, an embodiment of the present disclosure provides a pixel circuit. The pixel circuit includes a drive transistor, a storage capacitor, a data writing module, a reset module, a threshold compensation module and an organic light-emitting element.

The data writing module is electrically connected to a gate electrode of the drive transistor and a first plate of the storage capacitor and is configured to write a data signal to the gate electrode of the drive transistor and the first plate of the storage capacitor in a data writing phase.

The reset module is electrically connected to a second plate of the storage capacitor and is configured to write a reset signal to the second plate of the storage capacitor in the data writing phase.

The threshold compensation module is electrically connected to the second plate of the storage capacitor and configured to write a threshold compensation signal to the second plate of the storage capacitor in a threshold compensation phase to adjust the potential of the first plate of the storage capacitor to the first potential to compensate the threshold voltage of the drive transistor, where the threshold compensation signal is greater than the reset signal.

The drive transistor is electrically connected to the organic light-emitting element and configured to provide a drive current to the organic light-emitting element in a light emission phase to drive the organic light-emitting element to emit light.

In another aspect, an embodiment of the present disclosure provides a driving method applied to the above pixel circuit. The driving method includes the steps described below.

In a data writing phase, the data writing module writes a data signal to the gate electrode of the drive transistor and the first plate of the storage capacitor, and the reset module writes a reset signal to the second plate of the storage capacitor so that the potential of the second plate of the storage capacitor is equal to the potential of the reset signal.

In a threshold compensation phase, the threshold compensation module writes a threshold compensation signal to the second plate of the storage capacitor so that the potential of the second plate of the storage capacitor is equal to the potential of the threshold compensation signal and the threshold voltage of the drive transistor is compensated, where the threshold compensation signal is greater than the reset signal.

In a light emission phase, the drive transistor provides a drive current to the organic light-emitting element to drive the organic light-emitting element to emit light.

In yet another aspect, an embodiment of the present disclosure further provides a display panel including a display region and a non-display region surrounding the display region. The display region includes at least a first display region. The first display region includes first pixel circuits arranged in an array. The first pixel circuit is the pixel circuit described above.

In yet another aspect, an embodiment of the present disclosure further provides a display device including the display panel described above.

A pixel circuit, a driving method thereof, a display panel and a display device are provided. In a data writing phase, a data signal is written to the gate electrode of the drive transistor and the first plate of the storage capacitor through the data writing module, and a reset signal is written to the second plate of the storage capacitor through the reset module so that the potential difference is generated between the first plate and the second plate of the storage capacitor. In a threshold compensation phase, a threshold compensation signal is written to the second plate of the storage capacitor through the threshold compensation module, and the potential of the threshold compensation signal is larger than the potential of the reset signal written in the data writing phase so that the potential of the second plate of the storage capacitor is changed. Due to charge conservation of the storage capacitor, the voltage difference between the two plates of the storage capacitor needs to remain unchanged. Thus, when the potential of the second plate of the storage capacitor is changed from the reset signal to the threshold compensation signal, due to the coupling effect of the storage capacitor, the potential of the first plate of the storage capacitor may increase along with the increase of the potential of the second plate of the storage capacitor, and the potential of the first plate of the storage capacitor is adjusted to the first potential. The first potential is equal to the data signal written in the data writing phase plus the threshold voltage of the drive transistor, so that the threshold voltage of the drive transistor is compensated. Thus when the drive transistor provides the drive current to the light-emitting element in the light emission phase, the influence of threshold voltage fluctuation of the drive transistor on the luminescence of the light-emitting element can be reduced. The embodiments of the present disclosure can reduce the display unevenness caused by the threshold drift of the drive transistor, thereby improving the display effect. Meanwhile, the pixel circuit provided by the embodiments of the present disclosure has the advantages of simple structure, smaller size, and improving the resolution of the display panel or increasing the area of a high transmittance region in the display panel.

DETAILED DESCRIPTION

Figure 1:
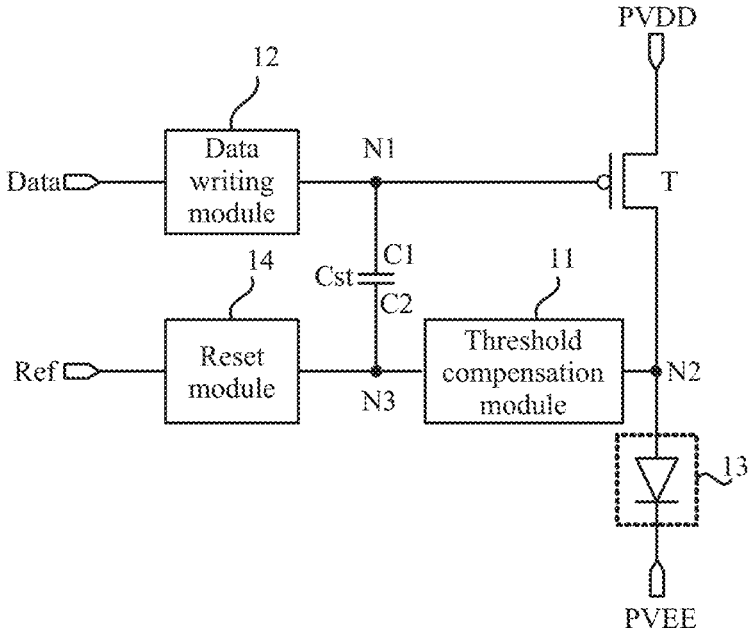
FIG. 1 is a schematic diagram of a pixel circuit according to an embodiment of the present disclosure.

Hereinafter the present disclosure will be further described in detail in conjunction with the drawings and embodiments. It is to be understood that the embodiments set forth below are merely intended to illustrate and not to limit the present disclosure. Additionally, it is to be noted that, for ease of description, only part, not all, of the structures related to the present disclosure are illustrated in the drawings.

As described in the background, due to the effect of manufacturing process and device aging, a threshold voltage of a drive transistor in a pixel drive circuit is shifted, resulting in display unevenness. The pixel circuit with the threshold compensation function in the related art is complex in structure, large in size and not beneficial to high PPI of the display panel. Meanwhile, the requirements of transmittance and display of a high transmittance region cannot be satisfied.

To solve the above problems, an embodiment of the disclosure provides a pixel circuit. The pixel circuit includes a drive transistor, a storage capacitor, a data writing module, a reset module, a threshold compensation module and an organic light-emitting element. The data writing module is electrically connected to the gate electrode of the drive transistor and the first plate of the storage capacitor, and configured to write a data signal to the gate electrode of the drive transistor and the first plate of the storage capacitor in a data writing phase. The reset module is electrically connected to the second plate of the storage capacitor, and configured to write a reset signal to the second plate of the storage capacitor in the data writing phase. The threshold compensation module is electrically connected to the second plate of the storage capacitor, and configured to write a threshold compensation signal to the second plate of the storage capacitor in a threshold compensation phase to adjust the potential of the first plate of the storage capacitor to a first potential to compensate the threshold voltage of the drive transistor. The threshold compensation signal is greater than the reset signal. The drive transistor is electrically connected to the organic light-emitting element, and configured to provide a drive current to the organic light-emitting element in a light emission phase to drive the organic light-emitting element to emit light.

According to the above technical solution, in the data writing phase, the data writing module writes the data signal to the gate electrode of the drive transistor and the first plate of the storage capacitor, and the reset module writes the reset signal to the second plate of the storage capacitor so that the first plate and the second plate of the storage capacitor have a potential difference. In the threshold compensation phase, the threshold compensation module writes the threshold compensation signal to the second plate of the storage capacitor, where the potential of the threshold compensation signal is different from the potential of the reset signal written in the data writing phase. Due to charge conservation of the storage capacitor, the voltage difference between the two plates of the storage capacitor remains unchanged. Thus, when the signal of the second plate of the storage capacitor changes from the reset signal to the threshold compensation signal, due to the coupling effect of the storage capacitor, the signal of the first plate of the storage capacitor changes along with the change of the signal of the second plate of the storage capacitor to adjust the potential of the first plate of the storage capacitor to the first potential. The first potential may be equal to the data signal written in the data writing phase plus at least part of the threshold voltage of the drive transistor, and thus the threshold compensation of the drive transistor is implemented. When the drive transistor provides the drive current to the light-emitting element in the light emission phase, the influence of threshold voltage fluctuation of the drive transistor on the luminescence of the light-emitting element can be reduced. The embodiments of the present disclosure can reduce the display unevenness caused by the threshold drift of the drive transistor, thereby improving the display effect. Meanwhile, the pixel circuit provided by the embodiments of the present disclosure has the advantages of simple structure, smaller size, and improving the resolution of the display panel or increasing the area of a high transmittance region in the display panel.

The above is a core concept of the present disclosure, and based on the embodiments of the present disclosure, all other embodiments obtained by those skilled in the art without creative work are within the scope of the present disclosure. Technical solutions in the embodiments of the present disclosure will be described clearly and completely in conjunction with the drawings in the embodiments of the present disclosure.

FIG. 1 is a structure diagram of a pixel circuit according to an embodiment of the present disclosure. As shown in FIG. 1, the pixel circuit includes a drive transistor T, a storage capacitor Cst, a data writing module 12, a threshold compensation module 11, a reset module 14, and an organic light-emitting element 13. The data writing module 12 is electrically connected to a gate electrode of the drive transistor T and a first plate C1 of the storage capacitor Cst. The data writing module 12 writes a data signal Vdata to the gate electrode of the drive transistor T and the first plate C1 of the storage capacitor Cst in a data writing phase. The reset module 14 is electrically connected to a second plate C2 of the storage capacitor Cst. The reset module 14 writes a reset signal Vref to the second plate C2 of the storage capacitor Cst in the data writing phase. The threshold compensation module 11 is electrically connected to the second plate C2 of the storage capacitor Cst and writes a threshold compensation signal Vthre to the second plate C2 of the storage capacitor Cst in a threshold compensation phase. The threshold compensation signal Vthre is different from the reset signal Vref written to the second plate of the storage capacitor Cst in the data writing phase. For example, the threshold compensation signal Vthre may be greater than the reset signal Vref to adjust the potential of the first plate C1 of the storage capacitor Cst to the first potential V1. At this point, the potential of the gate electrode of the drive transistor T electrically connected to the first plate C1 of the storage capacitor Cst is also adjusted to the first potential V1, and the threshold voltage of the drive transistor T is compensated. The drive transistor T is electrically connected to the organic light-emitting element 13, and the drive transistor T after threshold compensation can provide a drive current to the organic light-emitting element 13 in a light emission phase to drive the organic light-emitting element 13 to emit light.

In one or more embodiments, the pixel circuit may further include a data signal terminal for receiving the data signal Vdata, a reset signal terminal Ref for receiving the reset signal Vref, a power signal terminal PVDD for receiving a power signal Vdd, a low-level signal terminal PVEE for receiving a low-level signal Vee, a first node N1 electrically connected to the data writing module 12, the drive transistor T and the storage capacitor Cst, a second node N2 electrically connected to the threshold compensation module 11 and the organic light-emitting element 13, and a third node N3 electrically connected to the threshold compensation module 11, the first plate C1 of the storage capacitor Cst and the of the reset module 14.

In one or more embodiments, in the data writing phase, both the data writing module 12 and the reset module are switched on. The data signal Vdata of the data signal terminal Data can be written to the gate electrode of the drive transistor T and the first plate C1 of the storage capacitor Cst through the data writing module 12. Meanwhile, the reset signal Vref of the reset signal terminal Ref can be written to the second plate C2 of the storage capacitor Cst through the reset module 14, and the threshold compensation module 11 cannot write the signal to the second plate C2 of the storage capacitor. At this point, the potential of the first plate C1 of the storage capacitor Ct is the potential of the data signal Vdata, and the potential of the second potential C2 of the storage capacitor Cst is the potential of the reset signal Vref, such that the first plate C1 and the second plate C2 of the storage capacitor Cst have a voltage difference. In the threshold compensation phase, both the data writing module 12 and the reset module 14 are switched off, and the threshold compensation module 11 is switched on. A threshold compensation signal Vthre can be written to the second plate C2 of the storage capacitor Cst through the switched on threshold compensation module 11. The potential of the threshold compensation signal Vthre is different from the potential of the reset signal Vref, and accordingly the potential of the second plate of the storage capacitor Cst is increased. At this point, the potential increased amount of the second plate of the storage capacitor Cst is (Vthre−Vref).

Due to charge conservation of the capacitor, after the storage capacitor Cst is charged, the potential difference between the two plates of the storage capacitor Cst remains unchanged. If the potential of one plate of the storage capacitor Cst changes, the potential of the other plate of the storage capacitor Cst changes by coupling. Thus, at the end of the data writing phase, the potential of the first plate C1 of the storage capacitor Cst is the potential of the data signal Vdata, the potential of the second plate C2 of the storage capacitor Cst is the potential of the reset signal Vref, and the potential difference between the first plate C1 and the second plate C2 of the storage capacitor Cst is Vdata−Vref. In the threshold compensation phase, the potential of the second plate C2 of the storage capacitor Cst is adjusted to the potential of the threshold compensation signal Vthre, that is, the potential of the second plate C2 of the storage capacitor Cst is increased by Vthre−Vref. To maintain the potential difference between the two plates of the storage capacitor Cst as Vthre−Vref at the end of the data writing phase, the potential of the first plate C1 of the storage capacitor Cst should also be increased by Vthre−Vref. At this point, the potential of the first plate C1 of the storage capacitor Cst is adjusted to the first potential V1. The first potential V1 is equal to Vdata+Vthre−Vref. Since the first plate C1 of the storage capacitor Cst and the gate electrode of the drive transistor T are both electrically connected to the first node N1, the gate electrode potential of the drive transistor T is the same as the potential of the first plate C1 of the storage capacitor Cst. That is, the gate electrode potential of the drive transistor T after threshold compensation is Vdata+Vthre−Vref.

Additionally, the drive transistor T is further electrically connected to the power signal terminal PVDD and the anode of the organic light-emitting element 13. The power signal terminal PVDD can provide a power signal, and the cathode of the organic light-emitting element 13 is electrically connected to the low-level signal terminal PVEE. The low-level signal terminal PVEE can provide the low-level signal, and when the drive transistor T provides the drive current to the organic light-emitting element 13, a current loop is formed. When Vthre−Vref includes the threshold voltage Vth1 of the drive transistor T, the drive current $I_{ds}$ provided by the drive transistor T to the organic light-emitting element 13 is as follows.

$$I_{ds} = \frac{w}{2L}\mu C_{ox}(Vdata - Vthre - Vref - Vdd - Vth1)^2$$

W/L denotes the with-to-length ratio, also referred to herein as aspect ratio, of the drive transistor T, $C_{ox}$ denotes the capacitance per unit area of the gate electrode oxide of the drive transistor, and μ denotes the carrier mobility of the drive transistor T. When the gate electrode potential Vdata+Vthre−Vref of the drive transistor T includes the threshold voltage of the drive transistor T, the drive current provided by the drive transistor T to the organic light-emitting element 13 in the light emission phase is independent of the threshold voltage drift of the drive transistor T, thereby reducing display unevenness due to threshold voltage drift of the drive transistor T and improving the display effect.

Meanwhile, the storage capacitor Cst in the pixel circuit provided by the present disclosure has the characteristic of charge conservation and compensates the threshold voltage of the drive transistor T. Thus, without a complex compensation circuit, the threshold compensation of the drive transistor T can be implemented. Compared with the pixel circuit and the threshold compensation function in the related art, the pixel circuit provided by the present disclosure is simple in structure and smaller in size. When the pixel circuit is applied to the display panel, the resolution of the display panel is improved or the area of a high transmittance region in the display panel is increased without affecting the resolution of the display panel.

Moreover, since the second plate C2 of the storage capacitor Cst and the gate electrode of the drive transistor T are both electrically connected to the first node N1, the storage capacitor Cst may also serve as the gate electrode of the drive transistor T. For example, the first plate C1 of the storage capacitor Cst and the gate electrode of the drive transistor T may be disposed on the same layer and of an integral structure. In this way, no wire is required to be disposed between the storage capacitor Cst and the gate electrode of the drive transistor T, and the circuit may be further simplified, the size of the circuit may be reduced, and thereby the resolution of the display panel can be further improved, or the area of a high transmittance region in the display panel can be further increased.

It is to be noted that the specific structures of the data writing module, the reset module, and the threshold compensation module are not limited in the embodiments of the present disclosure. On the premise that the compensation of the threshold voltage of the drive transistor can be implemented by adopting the coupling effect of the storage capacitor, each module of the pixel circuit can be designed according to actual requirements.

Figure 2:
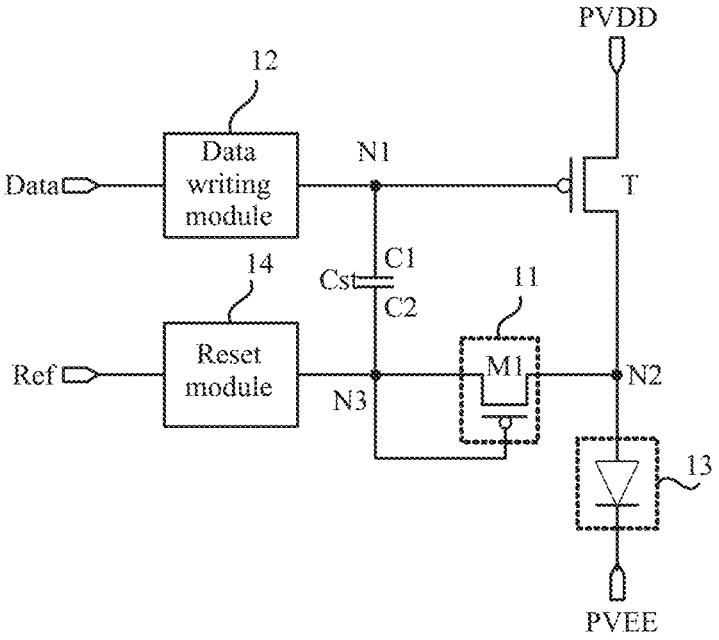
FIG. 2 is a schematic diagram of another pixel circuit according to an embodiment of the present disclosure.

FIG. 2 is a structure diagram of another pixel circuit according to an embodiment of the present disclosure. As shown in FIG. 2, the threshold compensation module 11 may include a first transistor M1. The threshold voltage Vth2 of the first transistor M1 is the first threshold voltage. The potential difference between the first potential V1 of the second plate C2 of the storage capacitor Cst in the data writing phase and the second potential V2 of the second plate C2 of the storage capacitor Cst in the threshold compensation phase includes at least the first threshold voltage Vth2 of the first transistor M1.

Specifically, the first electrode of the first transistor M1 may be electrically connected to the anode (the second node N2) of the organic light-emitting element 13, the gate electrode of the first transistor M1 is electrically connected to the second electrode (the third node N3) of the first transistor M1, and the second electrode of the first transistor M1 is also electrically connected to the second plate of the storage capacitor Cst. In this case, the gate electrode and the second electrode of the first transistor M1 are shorted and the first transistor M1 may be equivalent to a diode, that is, the first transistor M1 is in a diode connection state. A diode is switched on when being forward-biased and is switched off when being reverse-biased. When the potential of the second node N2 is larger than the potential of the third node N3, the signal of the second node N2 is written to the second plate C2 of the storage capacitor Cst through the first transistor M1. When the potential difference between the potential of the third node N3 and the potential of the second node is the threshold voltage Vth2 of the first transistor M1, the first transistor M1 is at the critical point of conduction. At this point, the second plate C2 of the storage capacitor Cst changes from the potential of the reset signal Vref to the potential of the threshold compensation signal Vthre, that is, the potential of the second plate C2 of the storage capacitor Cst is Vee+Voled+Vth2. Vee is the low-level signal received by the cathode of the organic light-emitting element 13, that is, the potential of the cathode of the organic light-emitting element 13. Voled is the potential difference between the anode and the cathode of the organic light-emitting element 13. Thus, compared with the data writing phase, the potential of the second plate C2 of the storage capacitor Cst is increased by ΔV=Vee+Voled+Vth2−Vref, that is, the potential difference ΔV between the potential of the second plate C2 of the storage capacitor Cst in the data writing phase and the potential of the second plate C2 of the storage capacitor Cst in the threshold compensation phase includes the first threshold voltage Vth2 of the first transistor M1. At this point, the potential of the first plate C1 of the storage capacitor Cst is increased by ΔV, and accordingly the potential of the first plate C1 of the storage capacitor Cst is adjusted to the first potential V1=Vdata+Vee+Voled+Vth2−Vref, and the gate electrode potential of the drive transistor T electrically connected to the first plate C1 of the storage capacitor Cst is also the first potential V1.

Thus, when the circuit is designed, the first transistor M1 may be disposed close to the drive transistor T, and accordingly the threshold voltage Vth2 of the first transistor M1 and the threshold voltage Vth1 of the drive transistor T have the same change trend. At this point, the difference value between the threshold voltage Vth2 of the first transistor M1 and the threshold voltage Vth1 of the drive transistor T is a fixed value. In the data writing phase, when the data signal Vdata is written to the gate electrode of the drive transistor T, the data signal Vdata may include the data voltage corresponding to the display gray scale value and the difference between the threshold voltage Vth2 of the first transistor M1 and the threshold voltage Vth1 of the drive transistor T, such that when the potential difference between the first potential V1 and the second potential V2 includes the threshold voltage Vth2 of the first transistor M, threshold compensation of the drive transistor T can be implemented, and the pixel display light-emitting effect is improved.

Alternatively, when the first transistor M1 is disposed close to the drive transistor T, the difference value between the threshold voltage Vth2 of the first transistor M1 and the threshold voltage Vth1 of the drive transistor T may be within a preset range so that after threshold compensation, the influence of the difference value between the threshold voltage Vth2 of the first transistor M1 and the threshold voltage Vth1 of the drive transistor T on the drive current may be ignored, the threshold of the drive transistor T can be compensated, and the display luminous effect of the pixel is improved.

Exemplarily, an active layer of the first transistor M1 includes a first channel, an active layer of the drive transistor T includes a second channel, and the distance W between the first channel and the second channel satisfies: 2.5 μm≤W≤4.5 μm. Thus, the first transistor M1 is close to the drive transistor T under the condition that the process design is satisfied so that threshold compensation for the drive transistor T can be implemented when the third potential V3 includes the threshold voltage Vth2 of the first transistor M1.

Figure 3:
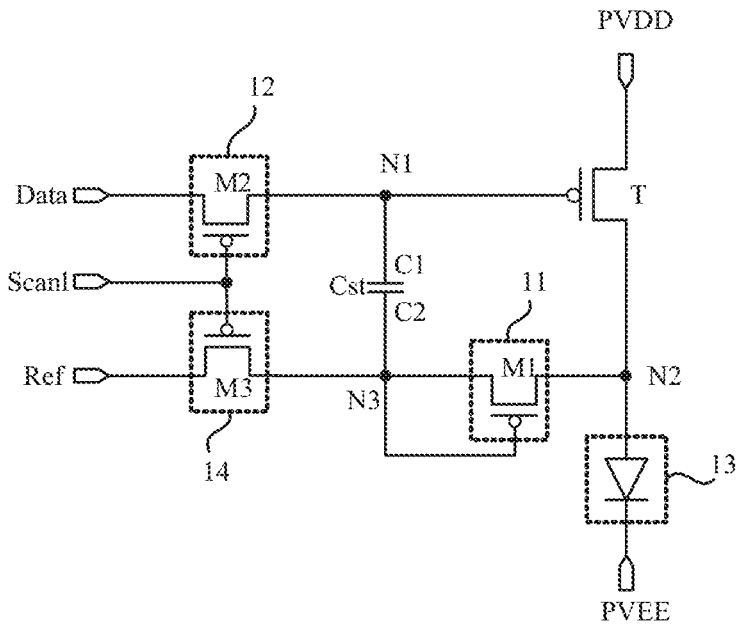
FIG. 3 is a circuit diagram of a pixel circuit according to an embodiment of the present disclosure.

FIG. 3 is a circuit diagram of a pixel circuit according to the embodiment of the present disclosure. As shown in FIG. 3, the threshold compensation module 11 includes a first transistor M1, the reset module 14 includes a third transistor M3, and the data writing module 12 includes a second transistor M2. The first electrode of the first transistor M1 is connected to the anode of the organic light-emitting element 13. The second electrode of the first transistor M1 and the gate electrode of the first transistor M1 are both electrically connected to the second plate C2 of the storage capacitor Cst. The first electrode of the third transistor M3 receives the reset signal Vref, the second electrode of the third transistor M3 is electrically connected to the second plate C2 of the storage capacitor Cst, and the gate electrode of the third transistor M3 receives a first scanning signal S1. The first electrode of the second transistor M2 receives the data signal Vdata, the second electrode of the second transistor M2 is electrically connected to the gate electrode of the drive transistor T and the first plate C1 of the storage capacitor Cst, and the gate electrode of the second transistor M2 receives the first scanning signal S1. The first electrode of the drive transistor T receives the power signal Vdd, and the second electrode of the drive transistor T is electrically connected to the anode of the organic light-emitting element 13. The cathode of the organic light-emitting element 13 receives the low-level signal Vee.

In one or more embodiments, the gate electrode of the second transistor M2 and the gate electrode of the third transistor M3 are both electrically connected to a first scanning signal terminal Scan1. The first scanning signal S1 of the first scanning signal terminal Scan1 can control the on-off of the second transistor M2 and the third transistor M3, that is, the first scanning signal S1 of the first scanning signal terminal Scan1 controls the second transistor M2 and the third transistor M3 to be switched on in the data writing phase and to be switched off in other phases so that the data signal Vdata of the data signal terminal Data can be written to the first node N1 through the switched-on second transistor M2, and the potential of the gate electrode of the drive transistor T and the potential of the first plate C1 of the storage capacitor Cst are the potential of the data signal Vdata. The reset signal Vref of the reset signal terminal Ref is written to the third node N3 through the switched-on third transistor M3 so that the potential of the second plate of the storage capacitor Cst is the potential of the reset signal Vref. At this point, the potential difference between the first plate C1 and the second plate C2 of the storage capacitor Cst is Vdata−Vref.

Meanwhile, when the reset signal Vref of the reset signal terminal Ref is written to the third node N3 through the switched-on third transistor M3, the first transistor M1 can not write the threshold compensation signal to the third node N3 under the influence of the reset signal Vref of the reset signal terminal Ref. When the third transistor M3 is switched off, and the potential difference between the third node N3 and the second node N2 causes the first transistor M1 to be switched on, and the influence of the reset signal Vref of the reset signal terminal Ref does not exist, the first transistor M1 can write the threshold compensation signal Vthre to the third node N3. When the potential difference between the third node N3 and the second node N2 does not satisfy the conduction condition of the first transistor M1, the first transistor M1 is switched off. If the threshold voltage of the first transistor M1 is Vth2, when the potential of the third node N3 is Vee+Voled+Vth2, the potential difference between the third node N3 and the second node N2 is the potential difference of the critical point of the conduction of the first transistor M1. That is, in the threshold compensation phase, the first transistor M1 can adjust the potential of the second plate C2 of the storage capacitor Cst to Vee+Voled+Vth2. Due to the coupling effect of the storage capacitor Cst, the potential of the first plate C1 of the storage capacitor Cst rises along with the rise of the potential of the second plate C2, and the potential of the first plate C1 of the storage capacitor Cst is adjusted to the first potential V1, that is, the gate electrode of the drive transistor T is the first potential V1. The first potential V1 is as follows.

$$V1 = V\text{data} + Vee + Voled + Vth2$$

Thus, when the threshold voltage Vth2 of the first transistor M1 is approximately equal to the threshold voltage Vth1 of the drive transistor T, the influence of the threshold voltage of the drive transistor T on the drive current provided by the drive transistor T to the organic light-emitting element 13 in the light emission phase may be negligible so that the threshold compensation of the drive transistor T is implemented, and the pixel display uniformity is improved.

Exemplarily, when the second transistor M2 and the third transistor M3 are both P-type transistors, the P-type transistors are switched on when the first scanning signal S1 of the first scanning signal terminal Scan1 is the low-level signal and are switched off when the first scanning signal S1 of the first scanning signal terminal Scan is the high-level signal. When the second transistor M2 and the third transistor are both N-type transistors, the N-type transistors are switched on when the first scanning signal S1 of the first scanning signal terminal Scan1 is the high-level signal, and are switched off when the first scanning signal S1 of the first scanning signal terminal Scan1 is the low-level signal.

Meanwhile, when the first transistor M1 is a P-type transistor, the P-type transistor is switched on when the potential difference between the third node N3 and the second node N2 is smaller than the threshold voltage Vth2 of the first transistor M1, and is switched off when the potential difference between the third node N3 and the second node N2 is larger than the threshold voltage Vth2 of the first transistor M1. When the first transistor M1 is an N-type transistor, the N-type transistor is switched on when the potential difference between the third node N3 and the second node N2 is larger than the threshold voltage Vth2 of the first transistor M1, and is switched off when the potential difference between the third node N3 and the second node N2 is smaller than the threshold voltage Vth2 of the first transistor M1.

Figure 4:
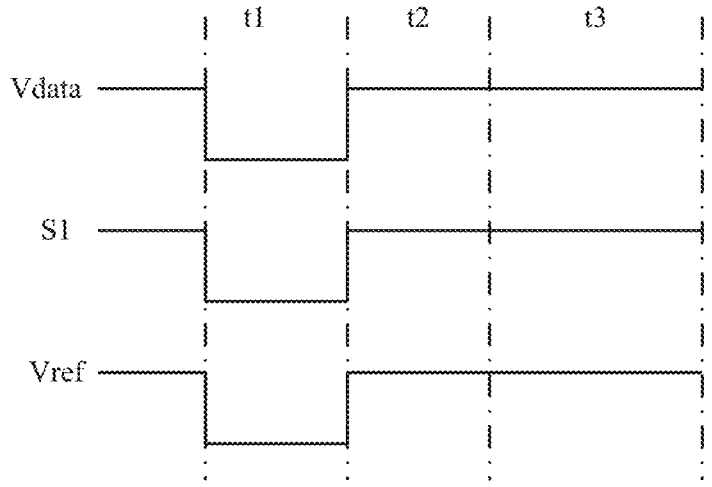
FIG. 4 is a drive timing diagram of a pixel circuit according to an embodiment of the present disclosure.

FIG. 4 is a drive timing diagram of a pixel circuit according to an embodiment of the present disclosure. As shown in FIG. 3 and FIG. 4, the threshold compensation module 11 includes the first transistor M1, the reset module 14 includes the third transistor M3, and the data writing module includes the second transistor M2. When the first transistor M1, the second transistor M2, the third transistor M3 and the drive transistor T are all P-type transistors, the working process of the pixel circuit includes the phases t1 to t3.

The phase t1 is the data writing phase. In the phase t1, the first scanning signal S1 of the first scanning signal terminal Scan1 controls the second transistor M2 and the third transistor M3 to be switched on, and the data signal Vdata of the data signal terminal Data is written to the first node N1 through the switched-on second transistor M2 so that the potential of the first plate C1 of the storage capacitor Cst and the potential of the gate electrode of the drive transistor T are both Vdata. Meanwhile, the reset signal Vref of the reset signal terminal Ref is written to the second plate C2 of the storage capacitor Cst through the switched-on third transistor M3. Thus, at the end of the data writing phase, the potential difference between the first plate C1 and the second plate C2 of the storage capacitor Cst remains Vdata−Vref.

The phase t2 is a threshold compensation phase. In the phase t2, the first scanning signal S1 of the first scanning signal terminal Scan1 controls the second transistor M2 and the third transistor M3 to be switched off. In addition, after the data signal Vdata is written to the gate electrode of the drive transistor T in the data writing phase, the drive transistor T is switched on, the power signal Vdd of the power signal terminal PVDD can raise the potential of the anode (the third node N3) of the organic light-emitting element 13 through the switched on drive transistor T, and the low-level reset signal Vref is written to the third node N3 in the data writing phase. At this point, the potential difference between the third node N3 and the second node N2 is smaller than the threshold voltage Vth2 of the first transistor M1 so that the first transistor M1 is switched on. Meanwhile, the gate electrode of the first transistor M1 is electrically connected to the second electrode of the first transistor M1 so that the first transistor M1 is equivalent to a diode, and the high-level potential of the second node N2 may be written to the second plate C2 (the third node N3) of the storage capacitor Cst through the switched on first transistor M1. When the potential difference between the third node N3 and the second node N2 is larger than the threshold voltage Vth2 of the first transistor M1, the first transistor M1 is switched off. At this point, the potential of the second plate C2 of the storage capacitor Cst is Vee+Voled+Vth2. Compared with the potential of the reset signal Vref written in the data writing phase, the potential of the second plate C2 of the storage capacitor Cst is increased by ΔV. ΔV=Vee+Voled+Vth2−Vref.

Since the capacitor has the characteristic of charge conservation, when the potential of the second plate C2 of the storage capacitor Cst is increased by ΔV, the potential of the first plate C1 of the storage capacitor Cst is also increased by ΔV due to the coupling effect, that is, the current potential of the first plate C1 of the storage capacitor Cst is adjusted to the first potential V1. V1=Vdata+Vee+Voled+Vth2−Vref.

The phase t3 is a light emission phase. In the phase t3, the potential of the first plate of the storage capacitor Cst remains the first potential V1, that is, the gate electrode of the drive transistor T is the first potential V1, and the drive current $I_{ds}$, generated by the drive transistor T according to the gate electrode potential V3 is as follows.

$$I_{ds}=W/(2L)\mu C_{ox}(V\text{data}+Vee+Voled+Vth2-V\text{ref}-Vdd-Vth1)^2$$

If the difference between the threshold voltage Vth2 of the first transistor M1 and the threshold voltage Vth1 of the drive transistor T is within a preset range, or is a fixed value, the drive current $I_{ds}$ generated by the drive transistor T in the light emission phase can be considered to be independent of the drift of the threshold voltage of the drive transistor T so that the purpose of threshold compensation is implemented, and the pixel display effect can be improved.

In the data writing phase t1, the low-level reset signal Vref is applied to the second plate C2 (the third node N3) of the storage capacitor Cst through the switched on third transistor M3, and the potential of the second node N2 is VEE+VOLED. Therefore, the potential of the second node N2 is larger than the potential of the third node N3, and the switched on condition of the first transistor M1 is satisfied. But since the gate electrode and the second electrode of the first transistor M1 are electrically connected, the first transistor M1 is always in a saturation state when the first transistor M1 is switched on and the first transistor M1 has a large resistance. Thereby, the potential of the second node N2 cannot be written to the third node N3, and only a certain current may be generated. Only after the third transistor M3 is switched off, in the threshold compensation phase t2, the potential of the second node N2 can be written to the third node N3 to raise the potential of the third node N3.

It is to be noted that FIG. 4 is just an exemplary drawing of this embodiment of the present disclosure. In FIG. 4, the data signal is written directly to the gate electrode of the drive transistor and the first plate of the storage capacitor in the data writing phase. In another embodiment of the present disclosure, before the data signal is written to the gate of the drive transistor and the first plate of the storage capacitor, an initialization signal is written to the gate electrode of the drive transistor and the first plate of the storage capacitor to initialize the gate electrode of the drive transistor and the first plate of the storage capacitor.

Figure 5:
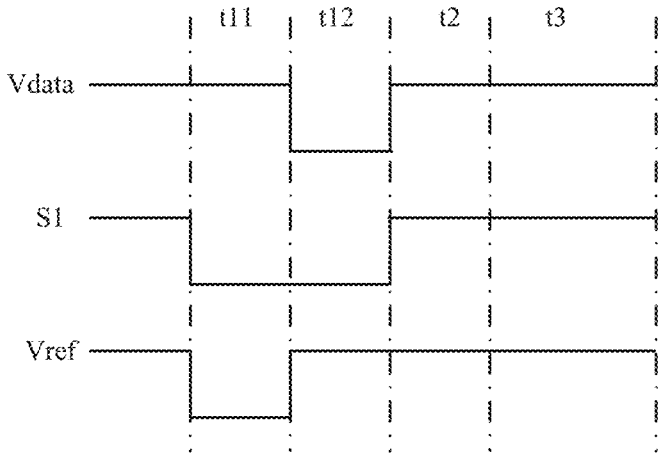
FIG. 5 is a drive timing diagram of another pixel circuit according to an embodiment of the present disclosure.

FIG. 5 is another drive timing diagram of the pixel circuit according to an embodiment of the present disclosure. For the same points in FIG. 5 as those in FIG. 4, reference may be made to the above description of FIG. 4, and details are not described herein again. As shown in FIG. 3 and FIG. 5, the data writing phase may include a first stage t11 and a second stage t12.

In the first stage t11, that is, in the first stage of the data writing phase, the second transistor M2 and the third transistor M3 are both switched on, and the high-level data signal Vdata is written to the gate electrode of the drive transistor T and the first plate C1 of the storage capacitor Cst through the switched on second transistor M2 to initialize the gate electrode of the drive transistor T and the first plate C1 of the storage capacitor Cst. Meanwhile, the reset signal Vref of the reset signal terminal Ref is written to the second plate C2 of the storage capacitor Cst and the gate electrode of the first transistor M1 through the switched on third transistor M3 to initialize the second plate C2 of the storage capacitor Cst and the gate electrode of the first transistor M1.

In the second stage t12, that is, in the second stage of the data writing phase, the second transistor M2 and the third transistor M3 remain switched on, the data signal Vdata is changed to a data signal corresponding to a display gray scale value, and the data signal Vdata corresponding to the display gray scale value is written to the gate electrode of the drive transistor T and the first plate C1 of the storage capacitor Cst through the switched on second transistor M2. Meanwhile, the reset signal Vref of the reset signal terminal Ref is written to the second plate C2 of the storage capacitor Cst through the switched on third transistor M3, and the potential of the reset signal Vref can be at least different from the potential of the second node N2 in the threshold compensation phase by the threshold voltage Vth2 of the first transistor M1. At the end of the data writing phase, the potential difference between the first plate C1 and the second plate C1 of the storage capacitor Cst is Vdata−Vref.

Thus, the initialization of the gate electrode of the drive transistor T before the data signal Vdata corresponding to the display gray scale value is written to the gate electrode of the drive transistor T and the first plate C1 of the storage capacitor Cst is beneficial to the data signal Vdata corresponding to the display gray scale value, and thereby the display effect of the pixel can be further improved after the threshold compensation of the drive transistor T.

It is to be noted that FIG. 4 and FIG. 5 are drive timing diagrams when the transistors in the pixel circuit are all P-type transistors. The P-type transistor is normally switched on under the control of a low-level signal and switched off under the control of a high-level signal. In some optional embodiments, the transistors in the pixel circuit may all be N-type transistors. The N-type transistor is normally switched on under the control of a high-level signal and switched off under the control of a low-level signal. The embodiments of the present disclosure do not specifically limit the types of transistors in the pixel circuit.

Figure 6:
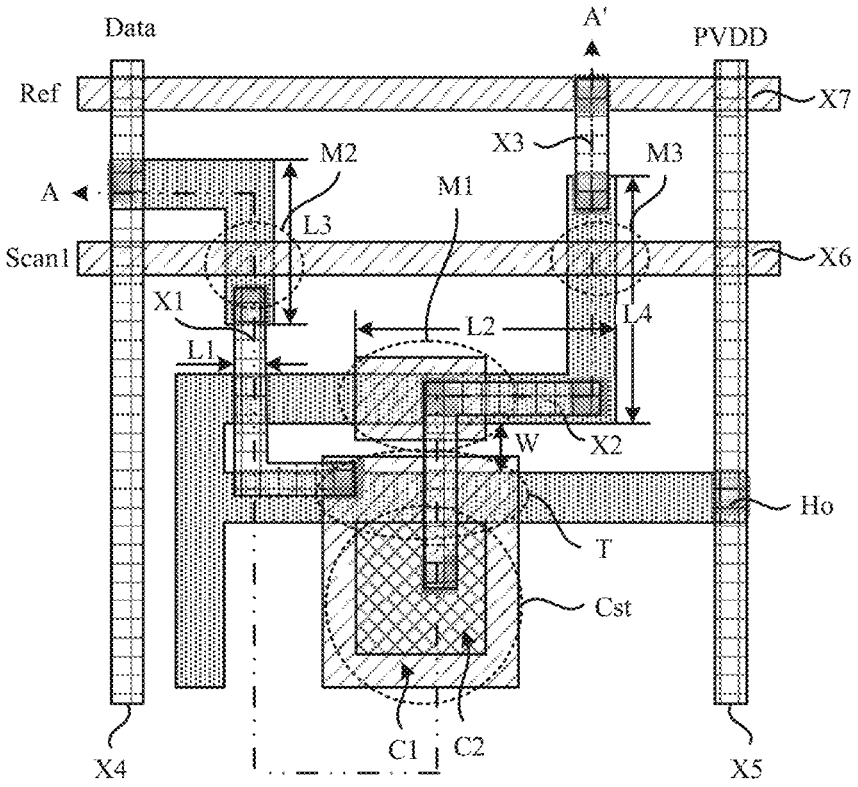
FIG. 6 is a top view of a pixel circuit according to an embodiment of the present disclosure.
Figure 7:
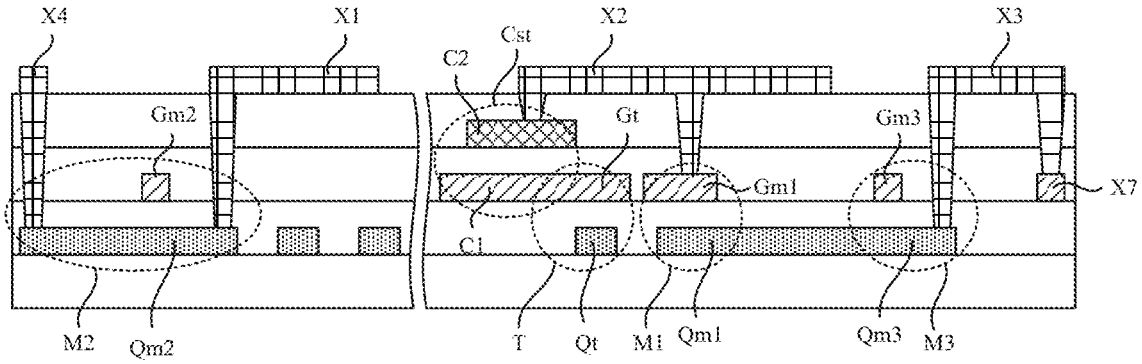
FIG. 7 is a section view of the pixel circuit taken along a line A-A' in FIG. 6.

FIG. 6 is a top view of a pixel circuit according to an embodiment of the present disclosure, and FIG. 7 is a section view of the pixel circuit taken along a line A-A' of FIG. 6. As shown in FIG. 3, FIG. 6 and FIG. 7, the pixel circuit further includes connect wires X1 and X2. The first transistor M1, the second transistor M2 and the third transistor M3 may be electrically connected to the storage capacitor Cst through different connect wires or different parts of the connect wires. For example, the second electrode of the second transistor M2 is electrically connected to the first plate of the storage capacitor through the connect wire X1, the first transistor M2 is electrically connected to the second plate of the storage capacitor Cst through the first part of the connect wire X2, and the third transistor M3 is electrically connected to the second plate of the storage capacitor Cst through the first part and the second part of the wire X2. The width L1 of each of the connect wire X1 and the connect wire X2 satisfies 1.5 μm≤L1≤2.5 μm. Meanwhile, the maximum extension length L2 of the vertical projection of the first transistor M1 on a reference plane satisfies: L2≤3 μm. The maximum extension length L3 of the vertical projection of the second transistor M2 on the reference plane satisfies: L3≤3 μm. The maximum extension length L4 of the vertical projection of the third transistor M3 on the reference plane satisfies: L4≤3 μm. The reference plane may be parallel to the plane of the active layer of the first transistor M1.

Thus, the connect wires X1, X2, the first transistor M1, the second transistor M2 and the third transistor M3 in the pixel circuit are small in size, the design size of the pixel circuit can be further reduced. In this way, when the pixel circuit is applied to the pixel of the high transmittance region of the display panel, the transmittance of the high transmittance region can be increased.

The pixel circuit may further include connect wires X3, X4, X5, X6 and X7. The first electrode of the third transistor M3 may be electrically connected to the reset signal terminal Ref through connect wires X3 and X7 in sequence. The first electrode of the second transistor M2 may be electrically connected to the data signal terminal Data through the connect wire X4. The gate electrode of the second transistor M2 and the gate electrode of the third transistor M3 may both be electrically connected to the first scanning signal terminal through the connect wire X6. The first electrode of the drive transistor T may be electrically connected to the power signal terminal PVDD through the connect wire X5. In the embodiment of the present disclosure, as long as the threshold compensation can be satisfied, the connect wires X3, X4, X5, X6 and X7 may have a same width as the connect wires X1 and X2 so that the size of the pixel circuit can be smaller.

Moreover, as shown in FIG. 6, the pixel circuit provided by the embodiment of the present disclosure may include a substrate; a semiconductor layer, a first metal layer, a second metal layer, a third metal layer on one side of the substrate; and insulating layers between the semiconductor layer, the first metal layer, the second metal layer, and the third metal layer. The semiconductor layer includes the active layer Qt of the drive transistor T, the active layer Qm1 of the first transistor M1, the active layer Qm2 of the second transistor M2 and the active layer Qm3 of the third transistor M3. The first metal layer includes the gate electrode Gt of the drive transistor T, the gate electrode Gm1 of the first transistor M1, the gate electrode Gm2 of the second transistor M2, the gate electrode Gm3 of the third transistor M3, the first plate C1 of the storage capacitor Cst and the connect wires X7 and X6. The first plate C1 of the storage capacitor Cst and the gate electrode Gt of the drive transistor T are of an integral structure. The second metal layer includes the second plate C2 of the storage capacitor Cst. The third metal layer includes connect wires X1, X2, X3, X4 and X5. Different layers of the pixel circuit may be connected through a via Ho. Correspondingly, the channel of the drive transistor T may be the overlapping region of the active layer Qt and the gate electrode Gt of the drive transistor T, and the channel of the first transistor M1 may be the overlapping region of the active layer Qm1 and the gate electrode Gm1 of the first transistor M1. The channel of the first transistor M1 may be parallel to the channel of the drive transistor T, and the distance W between the channel of the first transistor M1 and the channel of the drive transistor T satisfies: 2.5 μm≤W≤4.5 μm.

It is to be noted that in this embodiment of the present disclosure, the width of the connect wire is not the size of the connect wire in a fixed direction, but is the size of the connect wire along the short side. The size of the connect wire along the long side is related to the position of the device connected to the connect wire. The width of the connect wire is not particularly limited in the embodiments of the present disclosure. Meanwhile, FIG. 7 just shows an exemplary layer configuration and does not intend to limit the embodiments of the present disclosure.

Figure 8:
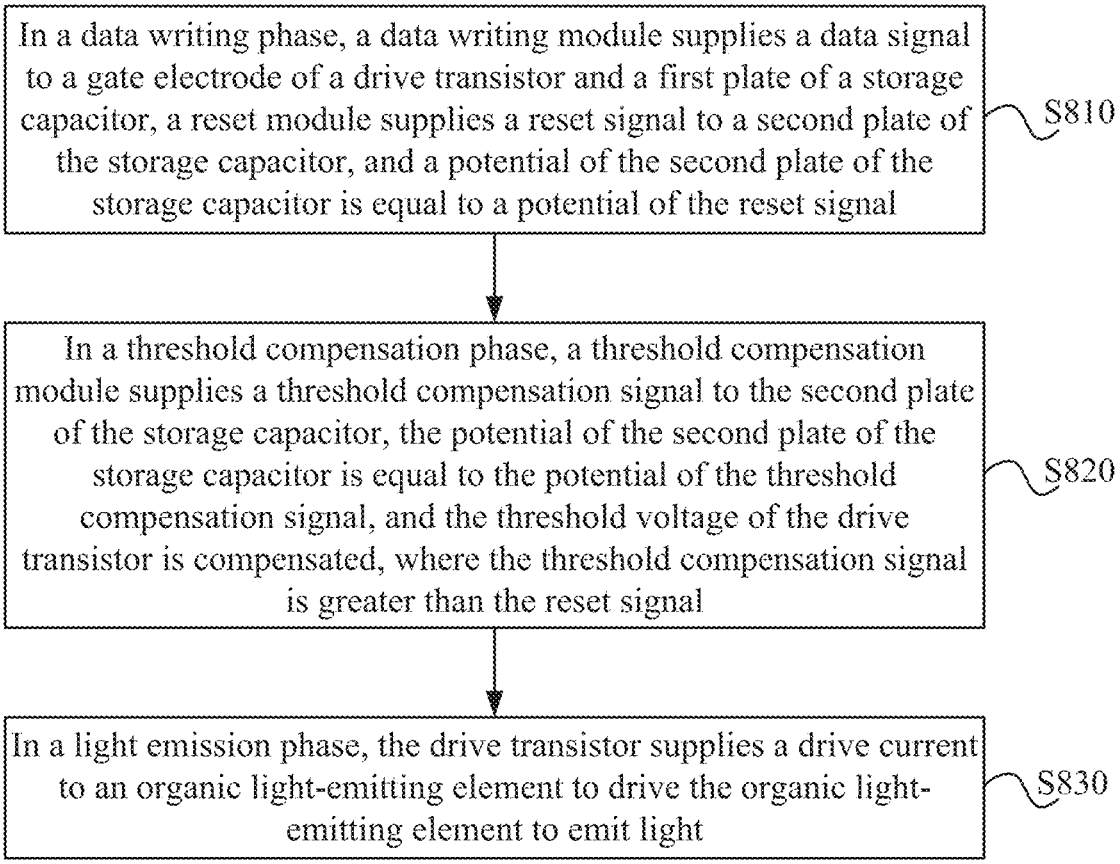
FIG. 8 is a flowchart of a method for driving a pixel circuit according to an embodiment of the present disclosure.

A method for driving a pixel circuit is further provided according to an embodiment of the present disclosure, and the driving method may be applied to the pixel circuit provided by the embodiments of the present disclosure. FIG. 8 is a flowchart of a method for driving a pixel circuit according to the embodiment of the present disclosure. As shown in FIG. 8, the driving method includes the steps described below.

In S810, in a data writing phase, the data writing module writes a data signal to the gate electrode of the drive transistor and the first plate of the storage capacitor, and the reset module writes a reset signal to the second plate of the storage capacitor so that the potential of the second plate of the storage capacitor is equal to the potential of the reset signal.

In S820, in a threshold compensation phase, the threshold compensation module writes a threshold compensation signal to the second plate of the storage capacitor so that the potential of the second plate of the storage capacitor is equal to the potential of the threshold compensation signal, and the threshold voltage of the drive transistor is compensated. The threshold compensation signal is greater than the reset signal.

In S830, in a light emission phase, the drive transistor provides a drive current to the organic light-emitting element to drive the organic light-emitting element to emit light.

The pixel circuit driving method provided by this embodiment of the present disclosure is applied to the pixel drive circuit shown in FIG. 1. As shown in FIG. 1, in the data writing phase, both the data writing module 12 and the reset module 14 are switched on, the data signal Vdata of the data signal terminal data is written to the gate electrode of the drive transistor T and the first plate C1 of the storage capacitor Cst through the switched on data writing module 12, and the reset signal Vref1 of the reset signal terminal Ref is written to the second plate C2 of the storage capacitor Cst through the switched on reset module 14 so that the first plate C1 and the second plate C2 of the storage capacitor Cst have a potential difference. In the threshold compensation phase, the data writing module 12 and the reset module 14 are both switched off, the threshold compensation module 11 is switched on, and the threshold compensation signal Vthre is written to the second plate C2 of the storage capacitor Cst through the switched on threshold compensation module 11 so that the potential of the second plate of the storage capacitor Cst is changed. Since the threshold compensation signal Vthre is greater than the reset signal Vref, the difference between the current potential of the second plate of the storage capacitor Cst and the potential of the second plate of the storage capacitor Cst at the end of the data writing phase is equal to $\Delta V = Vthre - Vref$. The coupling effect of the storage capacitor Cst makes the potential of the first plate C1 of the storage capacitor Cst also increased by $\Delta V$. At this point, the potential of the first plate C1 of the storage capacitor Cst is adjusted to the first potential $V1 = Vdata + Vthre - Vref$ so that threshold compensation of the drive transistor T is implemented, and the drive current provided by the drive transistor T to the organic light-emitting element 13 in the light emission phase can drive the organic light-emitting element 13 to emit light stably.

The coupling effect of the storage capacitor is adopted in the embodiment of the present disclosure. The first plate and the second plate of the storage capacitor have a potential difference in the data writing phase, and the potential of the second plate of the storage capacitor is changed in the threshold compensation phase so that the potential of the first plate of the storage capacitor changes along with the change of the potential of the second plate of the storage capacitor, the threshold compensation is implemented, and the display luminous effect of the pixel is improved.

In one or more embodiments, the threshold compensation module of the pixel circuit may include a first transistor, the data writing module may include a second transistor, and the reset module may include a third transistor. Exemplarily, as shown in FIG. 3, the threshold compensation module 11 of the pixel circuit includes the first transistor M1, the reset module 14 includes the third transistor M3, and the data writing module 12 includes the second transistor M2. The first electrode of the first transistor M1 is connected to the anode of the organic light-emitting element 13, and the second electrode of the first transistor M1 and the gate electrode of the first transistor M1 are both electrically connected to the second plate C2 of the storage capacitor Cst. The first electrode of the third transistor M3 receives the reset signal Vref, the second electrode of the third transistor M3 is electrically connected to the second plate C2 of the storage capacitor Cst, and the gate electrode of the third transistor M3 receives the first scanning signal S1. The first electrode of the second transistor M2 receives the data signal Vdata, the second electrode of the second transistor M2 is electrically connected to the gate electrode of the drive transistor T and the first plate C1 of the storage capacitor Cst, and the gate electrode of the second transistor M2 receives the first scanning signal S. The first electrode of the drive transistor T receives the power signal Vdd, and the second electrode of the drive transistor T is electrically connected to the anode of the organic light-emitting element 13. The cathode of the organic light-emitting element 13 receives the low-level signal Vee.

Figure 9:
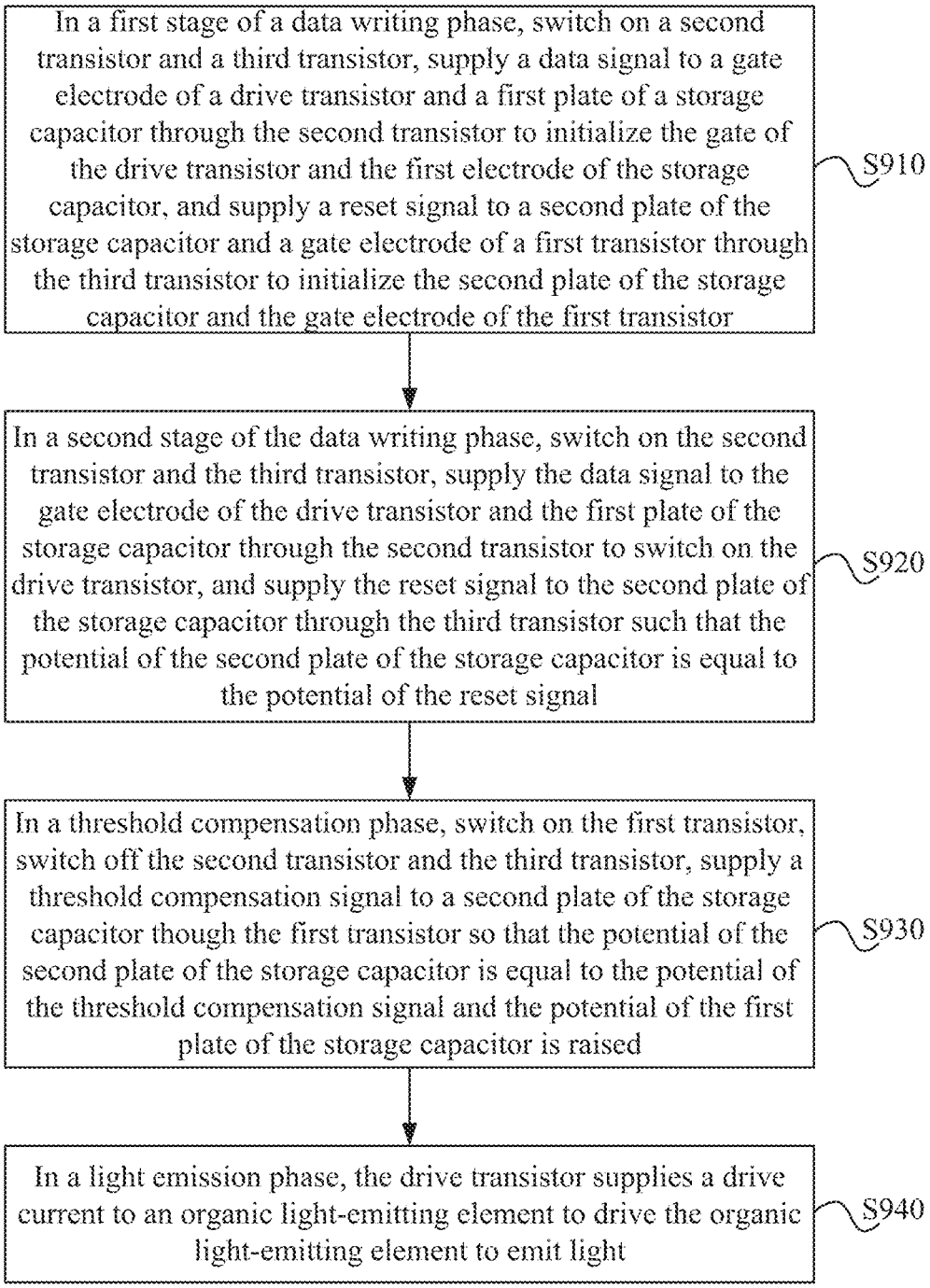
FIG. 9 is a flowchart of another method for driving a pixel circuit according to an embodiment of the present disclosure.

At this point, the data writing phase of the pixel circuit may include the first stage and the second stage. FIG. 9 is a flowchart of another method for driving a pixel circuit according to the embodiment of the present disclosure. As shown in FIG. 9, the driving method includes the steps described below.

In S910, in the first stage of the data writing phase, the second transistor and the third transistor are switched on, the data signal is written to the gate electrode of the drive transistor and the first plate of the storage capacitor through the second transistor to initialize the gate electrode of the drive transistor and the first electrode of the storage capacitor, and the reset signal is written to the second plate of the storage capacitor and the gate electrode of the first transistor through the third transistor to initialize the second plate of the storage capacitor and the gate electrode of the first transistor.

In S920, in the second stage of the data writing phase, the second transistor and the third transistor are switched on, the data signal is written to the gate electrode of the drive transistor and the first plate of the storage capacitor through the second transistor so that the drive transistor is switched on, and the reset signal is written to the second plate of the storage capacitor through the third transistor so that the potential of the second plate of the storage capacitor is equal to the potential of the reset signal.

In S930, in the threshold compensation phase, the first transistor is switched on, the second transistor and the third transistor are switched off, and the first transistor writes the threshold compensation signal to the second plate of the storage capacitor so that the potential of the second plate of the storage capacitor is equal to the potential of the threshold compensation signal. The threshold compensation signal is greater than the reset signal so that the potential of the first plate of the storage capacitor is raised.

In S940, in the light emission phase, the drive transistor provides the drive current to the organic light-emitting element to drive the organic light-emitting element to emit light.

Exemplarily, in the pixel circuit driving method provided by the embodiment of the present disclosure, the drive timing shown in FIG. 5 is applied to the pixel drive circuit shown in FIG. 3. As shown in FIG. 3 and FIG. 5, in the first stage t11 of the data writing phase, the first transistor M1 and the second transistor M2 are both switched on, and the initialized data signal Vdata of the data signal terminal Data is written to the gate electrode of the drive transistor T and the first plate C1 of the storage capacitor Cst through the switched on second transistor M2 to initialize the gate electrode of the drive transistor T and the first plate C1 of the storage capacitor Cst. Meanwhile, the reset signal Vref of the reset signal terminal Ref is written to the second plate C2 of the storage capacitor Cst through the switched on third transistor M3 to initialize the second plate Cst of the storage capacitor Cst and the gate electrode of the first transistor M1. In the second stage t12 of the data writing phase, the second transistor M2 and the third transistor M3 remain switched on, and the data signal Vdata corresponding to the display gray scale value of the data signal terminal Data is written to the gate electrode of the drive transistor T and the first plate C1 of the storage capacitor Cst through the switched on second transistor M2 to switch on the drive transistor T. Meanwhile, the reset signal Vref of the reset signal terminal Ref is written to the second plate C2 of the storage capacitor Cst through the switched on third transistor M3, and the potential of the reset signal Vref can be at least different from the potential of the second node N2 in the threshold compensation phase by the threshold voltage Vth2 of the first transistor M1. At this point, the first plate C1 and the second plate C2 of the storage capacitor Cst have a potential difference Vdata−Vref. In the threshold compensation phase, the second transistor M2 and the third transistor M3 are both switched off. Since the data signal Vdata is written to the gate electrode of the drive transistor T in the data writing phase, the drive transistor T is switched on, and the power signal Vdd of the power signal terminal PVDD may raise the potential of the anode (the third node N3) of the organic light-emitting element 13 through the switched on drive transistor T. The low-level reset signal Vref is written to the third node N3 in the data writing phase so that the potential difference between the third node N3 and the second node N2 satisfies the switched on condition of the first transistor M1. The first transistor M1 is switched on and the high-level potential of the second node N2 may be written to the second plate C2 (the third node N3) of the storage capacitor Cst through the switched on first transistor M1. When the potential difference between the third node N3 and the second node N2 reaches the critical value for switching on the first transistor M1, the first transistor M1 is switched off. At this point, the potential of the second plate C2 of the storage capacitor Cst is increased by $\Delta V = Vee + Voled + Vth2 - Vref$. Due to the coupling effect of the storage capacitor Cst, the potential of the first plate C1 of the storage capacitor Cst is correspondingly increased by $\Delta V$, and at this point, the potential of the first plate C1 of the storage capacitor Cst is adjusted to the first potential $V1 = Vdata + Vee + Voled + Vth2 - Vref$. When the influence of the difference between the threshold voltage Vth2 of the first transistor M1 and the threshold voltage Vth1 of the drive transistor T is negligible to the drive current, it may be considered that the drive current provided by the drive transistor T to the organic light-emitting element 13 is independent of the threshold voltage Vth1 of the drive transistor T. In this way, threshold compensation is implemented, and the display effect of the pixel is further improved.

A display panel is further provided in the embodiment of the present disclosure. The display panel includes the pixel circuit provided in the embodiment of the present disclosure. Therefore, the display panel has the beneficial effect of the pixel circuit provided by the embodiment of the present disclosure, and similarities can be understood with reference to the above, and will not be repeated in the following.

Figure 10:
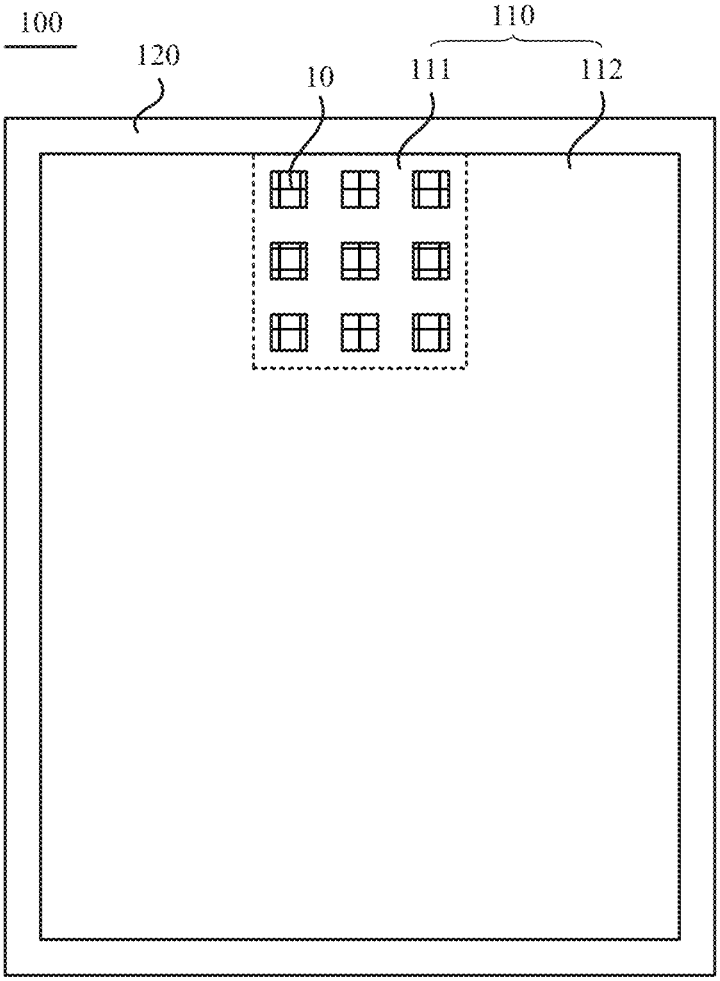
FIG. 10 is a schematic diagram of a display panel according to an embodiment of the present disclosure.

FIG. 10 is a diagram of a display panel according to an embodiment of the present disclosure. As shown in FIG. 10, the display panel 100 includes a display region 110 and a non-display region 120 surrounding the display region 110. The display region 110 includes at least a first display region 111, the first display region 111 includes first pixel circuits 10 arranged in an array, and the first pixel circuits 10 are the pixel circuits provided by the embodiment of the present disclosure. When the organic light-emitting elements in the first pixel circuits 10 emit light, the first display region 111 may display a corresponding picture.

The display region 110 of the display panel 100 may further include a second display region 112, the pixel circuits of the second display region 112 may also be the pixel circuits provided by this embodiment of the present disclosure. In this case, the pixel circuits of the display region of the display panel 100 are all the pixel circuits provided by this embodiment of the present disclosure. Compared with the pixel circuit with a threshold compensation structure in the related art, the pixel circuit provided by the embodiment of the present disclosure has a simple structure and a smaller design size. When the pixel circuits of the display panel 100 all adopt the pixel circuit provided by the embodiment of the present disclosure, the resolution of the display panel 100 is improved.

Alternatively, the pixel circuits of the second display region 112 of the display panel 100 may be any pixel circuit in the related art, such as a pixel circuit of 7T1C (seven transistors, one capacitor and one organic light-emitting element). The pixel circuit in the first display region 111 occupies a smaller area when the pixel density of the first display region 111 and the pixel density of the second display region 112 are the same. The area of the high transmittance region in the first display region 111 may be increased, and thereby the intensity of light transmitted through the first display region 111 may be increased.

FIG. 10 is a structure diagram of another display panel according to the embodiment of the present disclosure. As shown in FIG. 10, the display region of the display panel 100 further includes multiple first scanning signal lines 31, multiple reset signal lines 32, multiple data signal lines 41, and multiple power signal lines 42. The first pixel circuits 10 in the same row share one first scanning signal line 31 and one reset signal line 32. The first pixel circuits 10 in the same column share one data signal line 41 and one power signal line 42.

The non-display region 120 of the display panel 100 includes multiple cascaded first scanning drive circuits 51, multiple cascaded reset drive circuits 52 and an integrated drive circuit 60. An output terminal of the first scanning drive circuit 51 is electrically connected to a corresponding first scanning signal line 31 and configured to provide a first scanning signal S1 and transmit the first scanning signal S1 to the corresponding first pixel circuit 10 through the first scanning signal line 31. An output terminal of the reset drive circuit 52 is electrically connected to the corresponding reset signal line 32 and configured to provide a reset signal Vref and transmit the reset signal Vref to the corresponding first pixel circuit 10 through the reset signal line Vref. The data signal output terminals of the integrated drive circuit 60 are electrically connected to the data signal lines 41, and configured to provide the data signals Vdata to the data signal lines 41 and transmit the data signals Vdata to the first pixel circuits 10 through the data signal lines 41. The power signal output terminals of the integrated drive circuit 60 are electrically connected to the power signal lines 42, and configured to provide power signals Vdd to the power signal lines 42 and transmit the power signal to the first pixel circuits 10 through the power signal lines 42.

In an example embodiment, the first pixel circuit 10 is the pixel circuit shown in FIG. 3. As shown in FIG. 10 and FIG. 3, the reset signal terminals Ref of the first pixel circuits 10 in the same row are electrically connected to the same reset signal line 32, and the first scanning signal terminals Scan1 of the first pixel circuits 10 in the same row are electrically connected to the same first scanning signal line 31. The data signal terminals Data of the first pixel circuits 10 in the same column are electrically connected to the same data signal line 41, and the power signal terminals PVDD of the first pixel circuits 10 in the same column are electrically connected to the same power signal line 42. When the cascaded first scanning drive circuits 51 are electrically connected to the first scanning signal lines 31 in one-to-one correspondence, the first scanning signals S1 provided by the cascaded first scanning drive circuits 51 can control on-off of the second transistor M2 and the third transistor M3 of each first pixel circuit 10 row by row through the first scanning signal lines 31. When the second transistor M2 and the third transistor M3 of each first pixel circuit 10 are switched on, the data signal Vdata provided by the integrated drive circuit 60 can be written to the gate electrode of the drive transistor T and the first plate C1 of the storage capacitor Cst of the first pixel circuit 10 through the data signal line 41 and the switched on first transistor M1. The reset signal Vref provided by the reset drive circuit 52 can be written to the second plate C2 of the storage capacitor Cst through the switched on third transistor M3. When the cascaded reset drive circuits 52 are electrically connected to the reset signal lines 32 in one-to-one correspondence, the reset signals Vref provided by the cascaded reset drive circuits 52 are written to the second plate C2 of the storage capacitor Cst of each first pixel circuit 10 row by row through the reset signal lines 32. Meanwhile, the integrated drive circuit 60 may also provide power signals to the power signal terminals PVDD of first pixel circuits 10 in each column through the power signal lines 42 so that each first pixel circuit 10 can operate normally.

In this way, the first pixel circuits 10 of the first display region 111 can be driven row by row so that the threshold voltages of the drive transistors T of the first pixel circuits 10 in the first display region 111 can be compensated, the display uniformity of the first display region 111 is improved, and thereby display effect of the display panel 100 is improved.

Still referring to FIG. 10, the non-display region 120 of the display panel 100 includes at least a first non-display region 121 and a second non-display region 122. The first non-display region 121 and the second non-display region 122 are on two opposite sides of the display region 110. The first scanning drive circuits 51 may be disposed in the first non-display region 121, and the reset drive circuits 52 is disposed in the second non-display region 122.

The first scanning drive circuits 51 and the reset drive circuits 52 are disposed on two opposite sides of the display region 110 so that the frames on two opposite sides of the display region 110 are symmetric. Furthermore, the first scanning drive circuits 51 are disposed in the first non-display region 121, and the reset drive circuits 52 are disposed in the second non-display region 122 so that the wires of the first scanning drive circuits 51 and the wires of the drive circuits 52 are prevented from interfering with each other, the wiring design of the first scanning drive circuits 51 and the drive circuits 52 is facilitated, and the display effect of the display panel 100 is improved.

It is to be noted that FIG. 10 is only an exemplary drawing of the embodiment of the present disclosure. In FIG. 10, the first scanning drive circuits 51 and the reset drive circuits 52 are disposed on two opposite sides of the display region 110 of the display panel 100 to implement the above purpose. The first scanning drive circuits 51 and the reset drive circuits 52 may be disposed on the same side of the display region 110 regardless of the above purpose, which is not particularly limited in the embodiment of the present disclosure.

Figure 11:
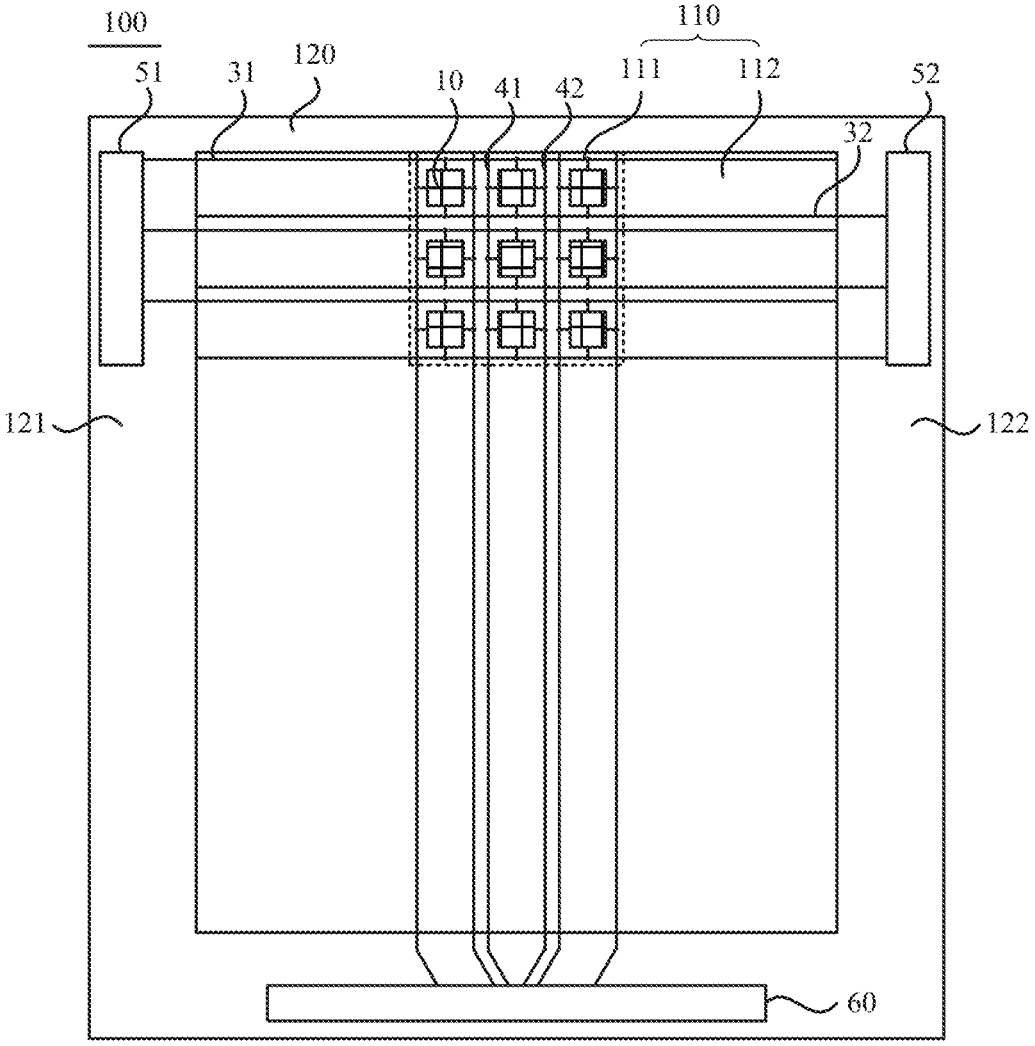
FIG. 11 is a schematic diagram of another display panel according to an embodiment of the present disclosure.
Figure 12:
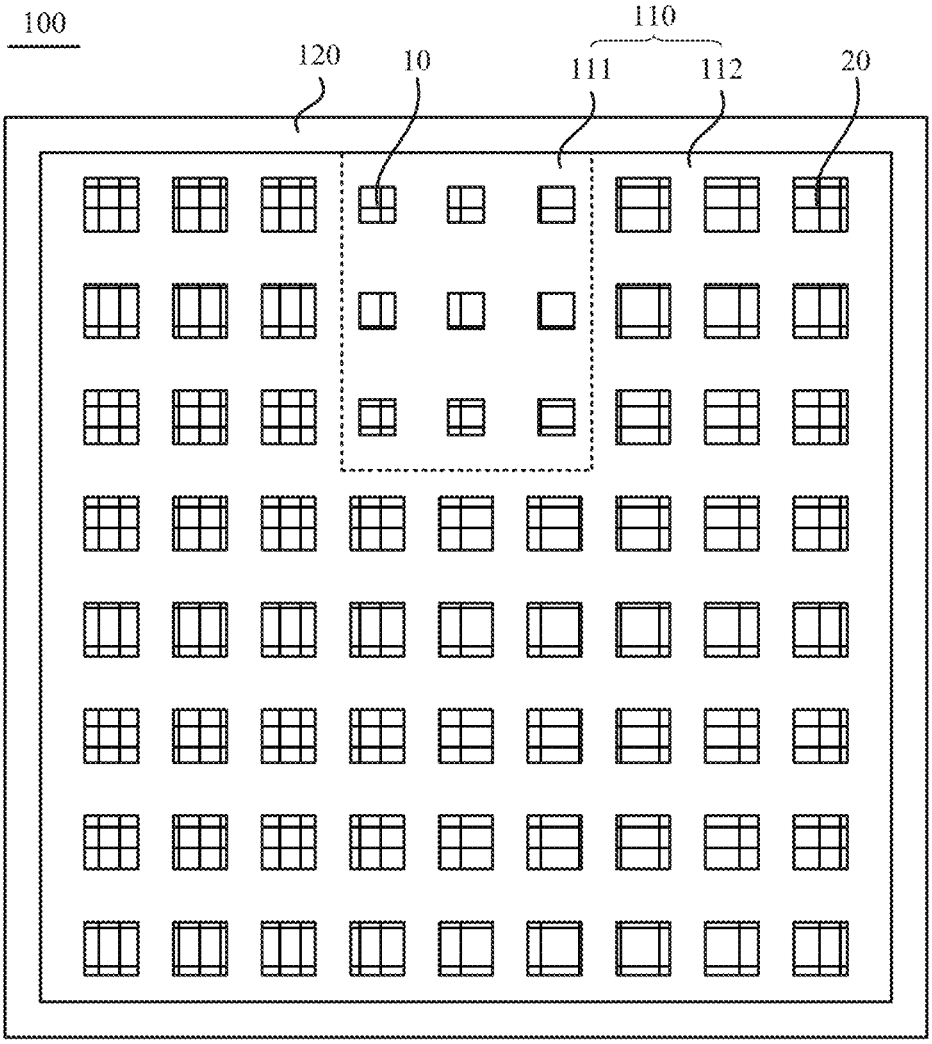
FIG. 12 is a schematic diagram of another display panel according to an embodiment of the present disclosure.

FIG. 11 is a structure diagram of another display panel according to the embodiment of the present disclosure. As shown in FIG. 11, the display region 110 of the display panel 100 includes the first display region 111 and the second display region 112. First pixel circuits in the first display region 111 may be the first pixel circuits 10, and second pixel circuits in the second display region 112 may be the second pixel circuits 20. That is, the first display region 111 includes the first pixel circuits 10 arranged in an array and the second display region 112 includes the second pixel circuits 20 arranged in an array. The coverage area of each second pixel circuit 20 is larger than the coverage area of each first pixel circuit 10.

When the number of the first pixel circuits 10 per unit area of the first display region 111 is the same as the number of the second pixel circuits 20 per unit area of the second display region 112, the first display region 111 may also serve as the sensor setting region. Since the first pixel circuits 10 disposed in the first display region 111 are the pixel circuits provided by this embodiment of the present disclosure, the first pixel circuits 10 disposed in the first display region 111 have a simple structure and small coverage area. The second pixel circuits 20 disposed in the second display region 112 may be any pixel circuit in the related art, and the area covered by the first pixel circuit 20 is larger. Compared with the case where the pixel circuits of the first display region 111 and the pixel circuits of the second display region 112 are both the second pixel circuits, the area of the high transmittance region in the first display region 111 can be increased. When the first display region 111 is also used as the sensor setting region, with ensuring a high screen-to-body ratio and display uniformity of the display panel 100, the area of the high transmittance region of the sensor setting region is increased, and thereby the intensity of light transmitted through the sensor setting region is increased. Exemplarily, when the camera is disposed in the sensor setting region, more external light can be collected by the camera through the first display region 111 so that the imaging quality of the camera can be improved.

Figure 13:
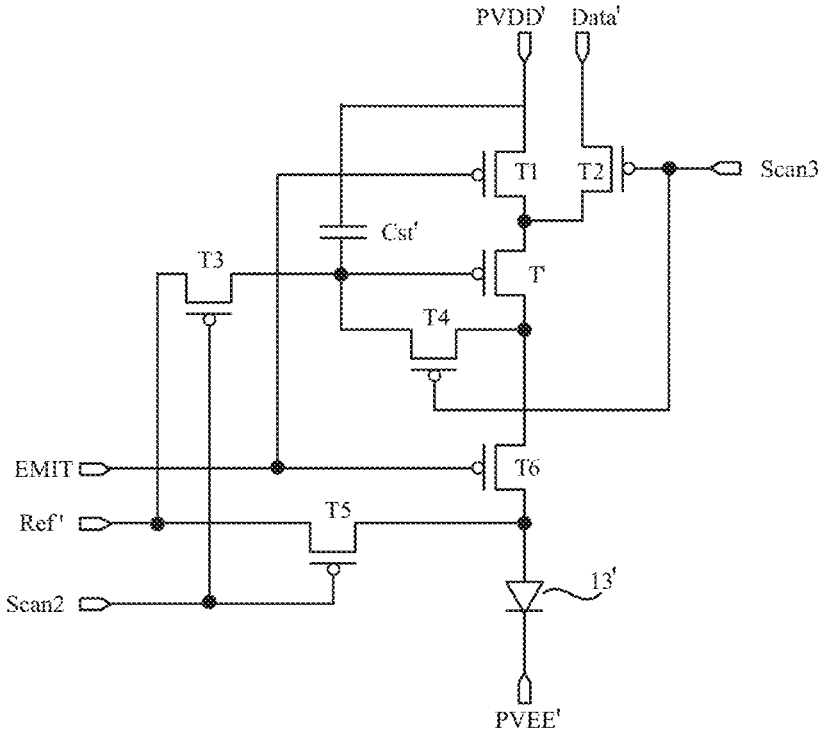
FIG. 13 is a schematic diagram of a second pixel circuit according to an embodiment of the present disclosure.
Figure 14:
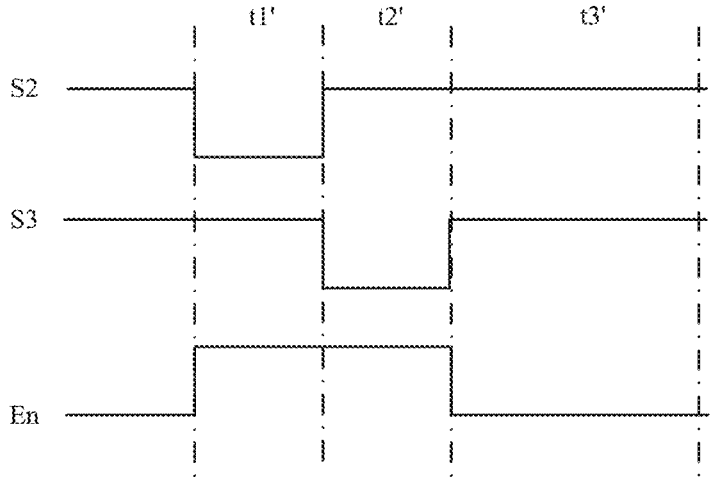
FIG. 14 is a drive timing diagram of a second pixel circuit according to an embodiment of the present disclosure.

FIG. 13 is a structure diagram of a second pixel circuit according to an embodiment of the present disclosure. FIG. 14 is a drive timing diagram of a second pixel circuit according to an embodiment of the present disclosure. As shown in FIG. 13 and FIG. 14, the second pixel circuit includes a drive transistor T', a storage capacitor Cst', an organic light-emitting element 13', light-emitting control transistors T1 and T6, initialization transistors T3 and T5, a data writing transistor T2, and a threshold compensation transistor T4. The second pixel circuit further includes a power signal terminal PVDD', a low-level signal terminal PVEE', a second reset signal terminal Ref', a light emission control signal terminal Emit, a second scanning signal terminal Scan2, and a third scanning signal terminal Scan3. The second scanning signal S2 of the second scanning signal terminal Scan2 may control the initialization transistors T3 and T5 to be switched on in the initialization phase t1' so that the reset signal Vref of the reset signal terminal Ref initializes the gate electrode of the drive transistor T', the storage capacitor Cst' and the anode of the organic light-emitting element 13' through the switched on transistors T3 and T5. The third scanning signal S3 of the third scanning signal terminal Scan3 controls the data writing transistor T2 and the threshold compensation transistor T4 to be switched on in the threshold compensation phase t2' so that the data signal Vdata of the data signal terminal Data' is written to the gate electrode of the drive transistor T' and the storage capacitor Cst' through the switched on data writing transistor T2 and the threshold compensation transistor T4. The light emission control signal En of the light emission control signal terminal Emit controls the light emission control transistors T1 and T6 to be switched on in the light emission control phase t3' so that the drive transistor T' provides a drive current to the organic light-emitting element 13' to drive the organic light-emitting element 13' to emit light, and the drive current provided by the drive transistor T' to the organic light-emitting element 13' is independent of the threshold voltage of the drive transistor T'. Thus, both the first pixel circuit and the second pixel circuit can implement the threshold compensation function so that the display uniformity of the display panel is improved, and thereby the display effect of the display panel is further improved.

Figure 15:
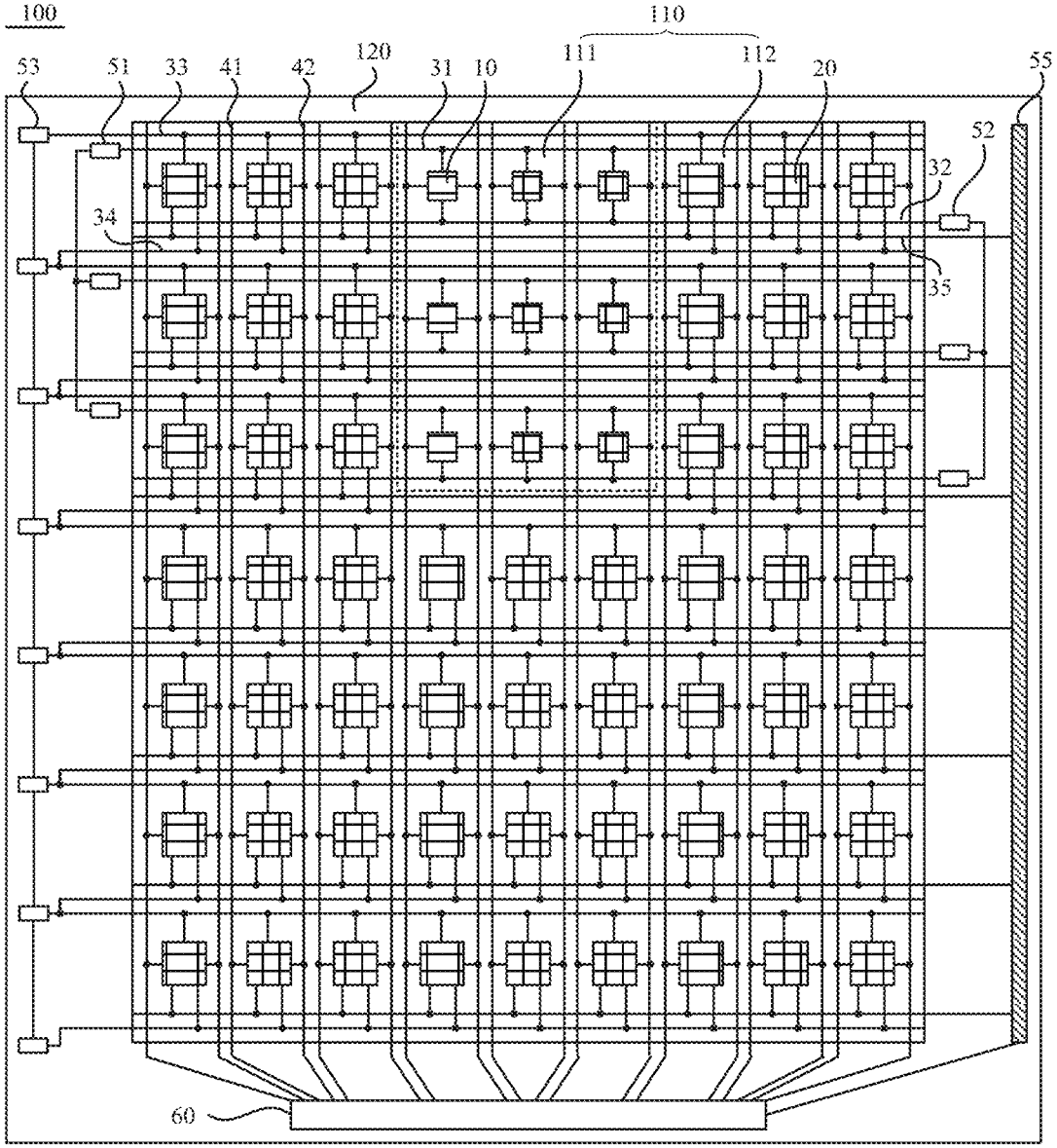
FIG. 15 is a schematic diagram of another display panel according to an embodiment of the present disclosure.

FIG. 15 is a structure diagram of another display panel according to the embodiment of the present disclosure. As shown in FIG. 15, the second display region 112 of the display panel 100 further includes multiple second scanning signal lines 33, multiple third scanning signal lines 34, multiple data signal lines 41, and multiple power signal lines 42. The second pixel circuits 20 in the same row share one second scanning signal line 33 and one third scanning signal line 34. The first pixel circuits 10 and the second pixel circuits 20 in the same column share one data signal line 41 and one power signal line 42.

The non-display region 120 of the display panel 100 further includes multiple cascaded second scanning drive circuits 53. Output terminals of the second scanning drive circuits 53 are electrically connected to the second scanning signal lines 33 and/or the third scanning signal lines 34. The second scanning drive circuits 53 electrically connected to the second scanning signal lines 33 are configured to provide second scanning signals S2 and transmit the second scanning signals S2 to the second pixel circuits 20 through the second scanning signal lines 33. The second scanning drive circuits 53 electrically connected to the third scanning signal lines 34 are configured to provide third scanning signals S3 and transmit the third scanning signals S3 to the second pixel circuits 20 through the third scanning signal lines 33. Meanwhile, the third scanning signals S3 of the second pixel circuits 20 in the previous row may serve as the second scanning signals S2 of the second pixel circuits 20 in the next row, that is, when the second pixel circuits 20 in the previous row are in the threshold compensation phase, the second pixel circuits 20 in the next row are in the initialization phase.

Moreover, the integrated drive circuit 60 disposed in the non-display region 120 of the display panel 100 is further configured to transmit data signals to the second pixel circuits 20 through the data signal lines 41, and transmit power signals to the second pixel circuits 20 through the power signal lines 42.

In one or more embodiments, the second pixel circuit 20 disposed in the second display region 112 has a larger size, and the second pixel circuit 20 also has the threshold compensation function and includes at least a second scanning signal terminal, a third scanning signal terminal, a data signal terminal, and a power signal terminal. At this point, the second scanning drive circuit 53 can provide the second scanning signal S2 to the second scanning signal terminals of the second pixel circuits 20 in the same row through the second scanning signal line 33. The second scanning drive circuit 53 may further provide the third scanning signal S3 to the third scanning signal terminals of the second pixel circuits 20 in the same row through the third scanning signal line 34. Meanwhile, the integrated drive circuit 60 can further provide the data signals Vdata to the data signal terminals of the second pixel circuits 20 in the same column through the data signal line 41, and provide the power signal Vdd to the power signal terminals of the second pixel circuits 20 in the same column through the power signal line 42. In this way, the pixel circuits in the display panel 100 are driven row by row and the display panel displays a corresponding picture.

Moreover, to adapt the drive timing sequence of the second pixel circuits 20, the display panel 100 further includes a reset signal bus 55 and reset signal lines 35 for transmitting a reset signal to the second pixel circuits 20. The second pixel circuits 20 in the same row are electrically connected to one reset signal line 35. The reset signal Vref' from the integrated drive circuit 60 may be sequentially transmitted to the second pixel circuits 20 through the reset signal bus 55 and the reset signal lines 35.

It is to be noted that FIG. 15 is just an exemplary drawing of this embodiment of the present disclosure. In FIG. 15, the first scanning drive circuits 51 and the second scanning drive circuits 53 are on the same side of the display region 110. In other embodiments, the first scanning drive circuits 51 and the second scanning drive circuit 53 may be on different sides of the display region 110, or the first scanning drive circuit 51 and the second scanning drive circuit 53 may be integrated to one scanning drive circuit, which is not particularly limited in the embodiment of the present disclosure.

Moreover, since the coverage area of the second pixel circuit is larger than the coverage area of the first pixel circuit, the load of the second pixel circuit is larger than the load of the first pixel circuit. Thus, the data signal line, the power signal line, the second scanning signal line and the first scanning signal line of the second display region are wider than the data signal line, the power signal line and the first scanning signal line of the first display region for connecting the first pixel circuits. On one hand, the load of the first display region may be increased during signal transmissions so that the signal transmitted to the first display region is consistent with the signal transmitted to the second display region remain, and the display uniformity of the display panel is improved. On the other hand, the signal line width of the first display region is smaller, the area of the high transmittance region of the first display region may be further increased, and thus when the first display region also serves as the sensor setting region, the intensity of light collected by the sensor can be improved, and the imaging quality of an image sensor such as a camera can be further improved.

Figure 16:
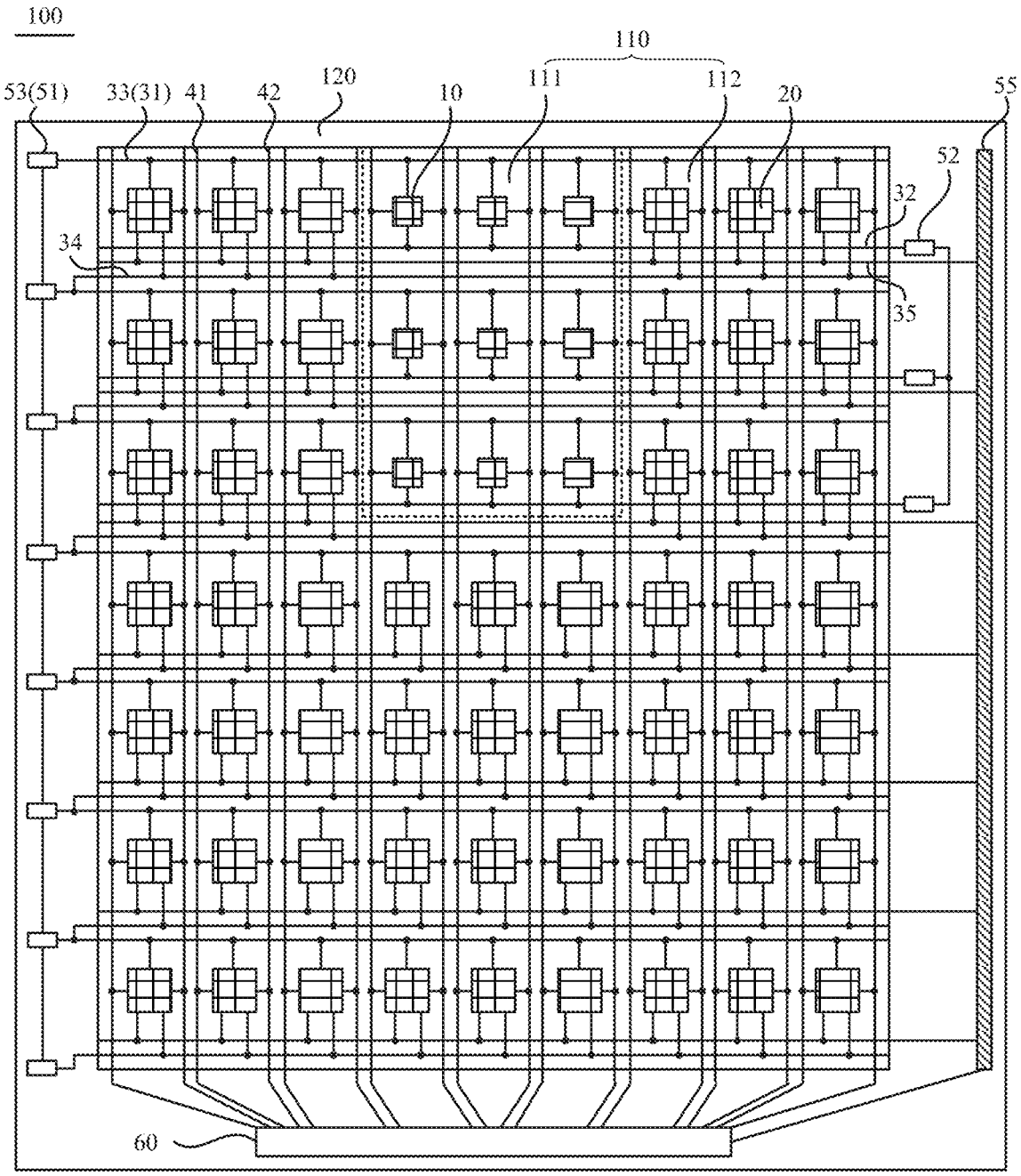
FIG. 16 is a schematic diagram of another display panel according to an embodiment of the present disclosure.

FIG. 16 is a structure diagram of another display panel according to the embodiment of the present disclosure. As shown in FIG. 16, the second scanning drive circuits 53 may also serve as the first scanning drive circuits 51, and the second scanning signal lines 33 or the third scanning signal lines 34 also serve as the first scanning signal lines 31.

Exemplarily, the first pixel circuit shown in FIG. 3 and the drive timing shown in FIG. 4 are taken as an example, and the second pixel circuit shown in FIG. 13 and the drive timing shown in FIG. 14 are taken as an example. As shown in FIG. 3, FIG. 4, FIG. 13, FIG. 14 and FIG. 16, the second scanning drive circuit 53 can provide the second scanning signal S2 to the second scanning signal terminal Scan2 of the second pixel circuit 20 through the second scanning signal line 33. The second scanning drive circuit 53 can further provide the third scanning signal S3 to the third scanning signal terminal Scan3 of the second pixel circuit 20 through the third scanning signal line 34. When the second scanning drive circuit 53 is multiplexed as the first scanning drive circuit 51 and the second scanning signal line 33 is multiplexed as the first scanning signal line 31, the second scanning drive circuit 53 can provide a low-level first scanning signal S1 to the first scanning signal terminals Scan1 of the first pixel circuits 10 in the same row and a low-level second scanning signal S2 to the second scanning signal terminals Scan2 of the second pixel circuits 20 through the second scanning signal line 33 so that the first pixel circuits 10 enter the data writing phase t1 and the second pixel circuits 20 enter the initialization phase t1'. Meanwhile, the second scanning drive circuit 53 can provide the high-level first scanning signal S1 to the first scanning signal terminals Scan1 of the first pixel circuits 10 in the same row through the second scanning signal line 33 so that the first pixel circuits 10 enter the threshold compensation phase t2. At this point, the second pixel circuits 20 may enter the threshold compensation phase t2'. Thus, the number of drive circuits in the non-display region 110 can be reduced, the size of the non-display region 110 can be reduced, and a narrow frame of the display panel 100 can be implemented.

Alternatively, when the third scanning signal lines are multiplexed as the reset signal lines, the second scanning drive circuit may provide the low-level reset signal Vref required in the first stage t11 of the data writing phase to the reset signal terminals of the first pixel circuits in the same row through the third scanning signal line and provide the third scanning signal S3 required in the threshold compensation phase t2' to the third scanning signal terminals of the second pixel circuits. Meanwhile, when the first pixel circuit enters the second stage t12 of the data writing phase, the second scanning drive circuit can provide a high-level reset signal Vref to the reset signal terminals of the first pixel circuits in the same row through the third scanning signal line. At this point, the second pixel circuit enters the light emission phase t3'. Thus, the first pixel circuits and the second pixel circuits are driven row by row, the number of the drive circuits in the non-display region can be reduced, the size of the non-display region can be reduced, and the narrow frame of the display panel can be implemented.

Figure 17:
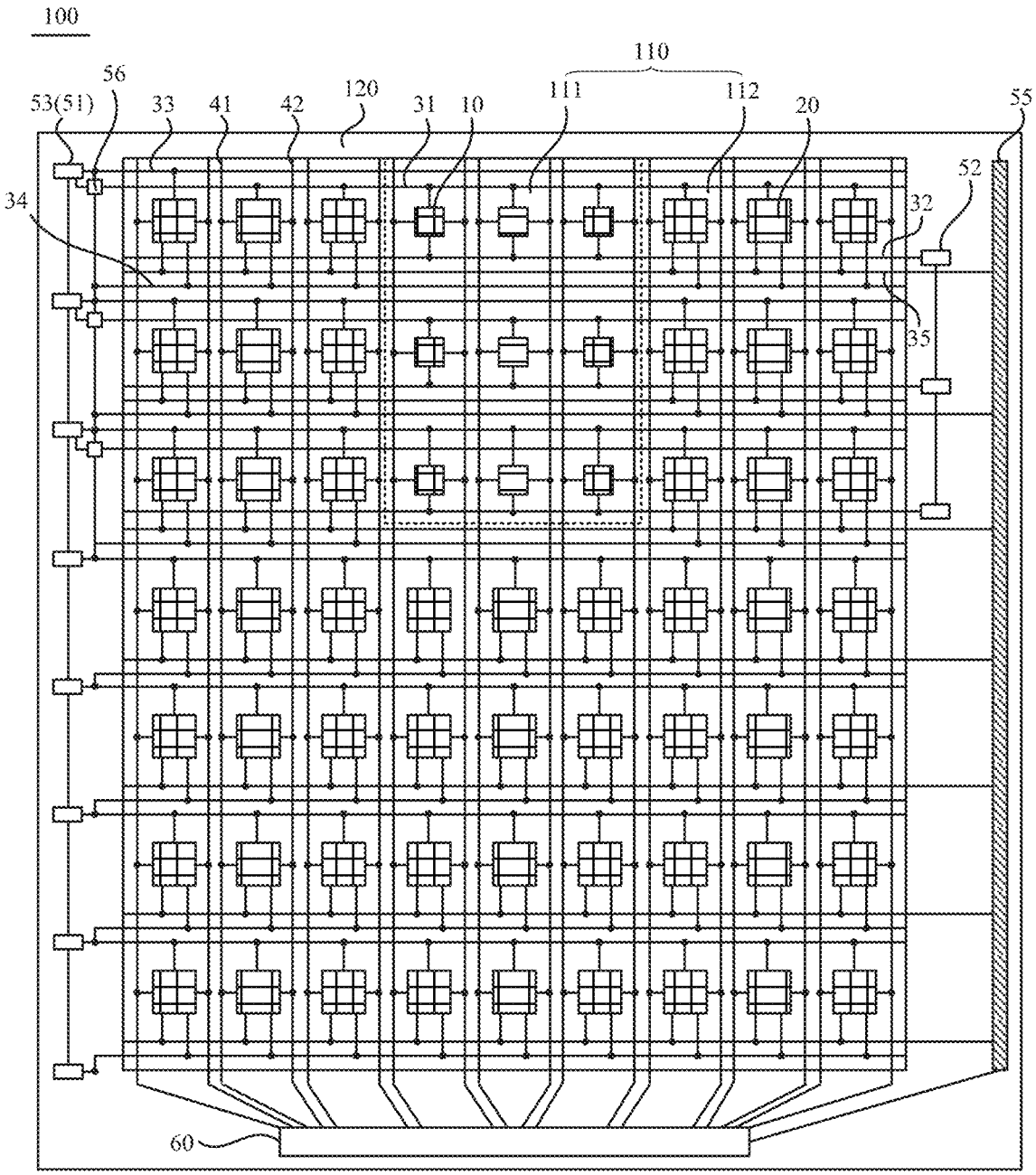
FIG. 17 is a schematic diagram of another display panel according to an embodiment of the present disclosure.

FIG. 17 is a structure diagram of another display panel according to the embodiment of the present disclosure. As shown in FIG. 17, the non-display region 120 of the display panel 100 further includes multiple converter circuits 56. Each converter circuit 56 is electrically connected between a corresponding second scanning drive circuit 53 and a corresponding first scanning signal line 31. The converter circuit 56 is configured to convert a low-level signal VGL of the second scanning drive circuit 53 into the first scanning signal S1 in the data writing phase and convert the second scanning signal S2 or the third scanning signal S3 provided by the second scanning drive circuit 53 into the high-level first scanning signal S in the threshold compensation phase. Thus, there is no need to arrange the first scanning drive circuits for providing the first scanning signals S1 to the first pixel circuits in the non-display region 120, the pixel circuit in the non-display region 120 can be simplified, the size of the non-display region 120 of the display panel 100 is reduced, and thus the narrow frame of the display panel is implemented.

It is to be noted that the embodiment of the present disclosure does not limit the specific structure of the converter circuits on the premise that the second scanning signal S2, the third scanning signal S3, and the low-level signal VGL can be converted to the first scanning signal S1.

Figure 18:
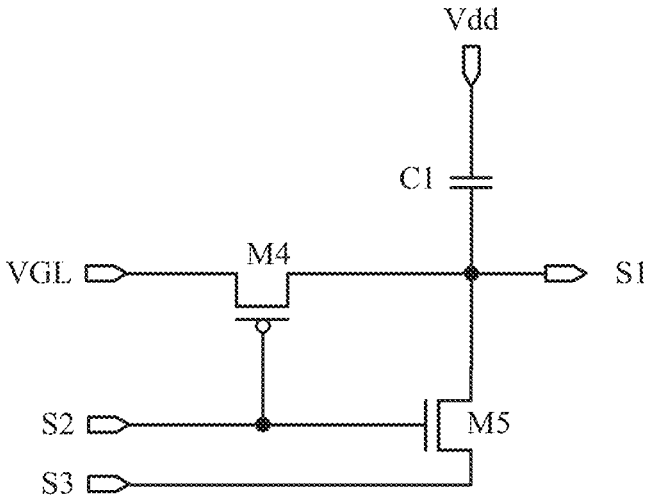
FIG. 18 is a circuit diagram of a converter circuit according to an embodiment of the present disclosure.

FIG. 18 is a structure diagram of a converter circuit according to an embodiment of the present disclosure. As shown in FIG. 18, the converter circuit includes a fourth transistor M4, a fifth transistor M5 and a first capacitor C1. A first electrode of the fourth transistor M4 is electrically connected to a low-level signal VGL of the second scanning drive circuit 53. A second electrode of the fourth transistor M4 is electrically connected to the first scanning signal line 31. A gate electrode of the fourth transistor M4 is electrically connected to the output terminal of the second scanning drive circuit 53 through the second scanning signal line 33. A first electrode of the fifth transistor M5 is electrically connected to the output terminal of the second scanning drive circuit 53 through the third scanning signal line 34, a second electrode of the fifth transistor M5 is electrically connected to the first scanning signal line 31, and a gate electrode of the fifth transistor M5 is electrically connected to the output terminal of the second scanning drive circuit 53 through the second scanning signal line 33. The first plate of the first capacitor C1 is electrically connected to the first scanning signal line 31, and the second plate of the first capacitor C1 is electrically connected to a fixed potential signal line.

Figure 19:
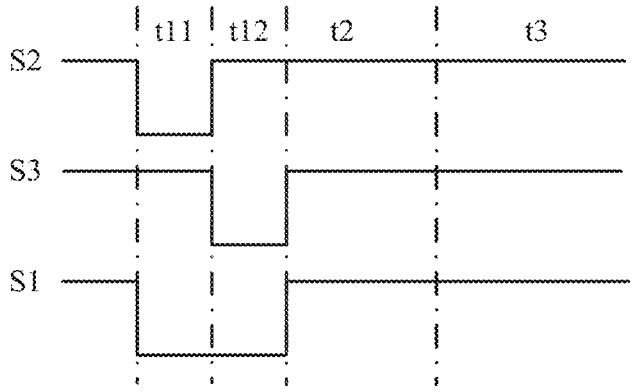
FIG. 19 is a drive timing diagram of a converter circuit according to an embodiment of the present disclosure.

Exemplarily, the first pixel circuit shown in FIG. 3 and the drive timing shown in FIG. 5 are taken as an example, and the second pixel circuit shown in FIG. 13 and the drive timing shown in FIG. 14 are taken as an example. FIG. 19 is a drive timing diagram of a converter circuit according to an embodiment of the present disclosure. As shown in FIG. 3, FIG. 5, FIG. 13, FIG. 14, FIG. 17, FIG. 18 and FIG. 19, the fourth transistor M4 of the converter circuit 56 is a P-type transistor and the fifth transistor M5 is an N-type transistor. In the initialization phase t1' of the second pixel circuit 20, the second scanning signal S2 provided by the second scanning drive circuit 53 is a low-level signal, the fourth transistor M4 is switched on, the fifth transistor M5 is switched off, and the low-level signal of the second scanning drive circuit 53 may be transmitted to the first scanning signal line 31 through the switched on fourth transistor M4, the first scanning signal S1 required in the first stage t11 of the data writing phase is supplied to the first pixel circuit 10, and the second transistor M2 and the third transistor M3 are switched on. In the threshold compensation phase t2 of the second pixel circuit 20, the second scanning signal S2 provided by the first scanning drive circuit 51 is flipped to a high-level signal, the third scanning signal S3 provided by the second scanning drive circuit 53 is a low-level signal, the fourth transistor M4 is switched off, the fifth transistor M5 is switched on, and the third scanning signal S3 is transmitted to the first scanning signal line 31 through the switched on fifth transistor M5, the first scanning signal required in the second stage t12 of the data writing phase is supplied to the first pixel circuits 10, and the second transistor M2 and the third transistor M3 remain switched on. In this way, when the second pixel circuit 20 is in the initialization phase t1', the first pixel circuit 10 is in the first stage t11 of the data writing phase. When the second pixel circuit 20 is in the threshold compensation phase t2', the first pixel circuit 10 is in the second stage t12 of the data writing phase. When the second pixel circuit 20 is in the light emission phase t3', the first pixel circuit 10 is in the threshold compensation phase t2, and at this point, the drive transistor T of the first pixel circuit 10 has started to provide the drive currents to the organic light-emitting element, that is, the organic light-emitting element of the first pixel circuit 10 and the organic light-emitting element of the second pixel circuit 20 can emit light at the same time so that the display uniformity of the display panel can be improved, and the display effect of the display panel can be improved.

A fixed potential on the fixed potential signal line is the power signal provided by the integrated drive circuit. The integrated drive circuit does not need to include an additional output terminal for outputting the fixed potential signal required by the converter circuits. In this manner, the integrated drive circuit is simplified, the cost of the integrated drive circuit is reduced, and thus the cost of the display panel is reduced.

It is to be noted that the fifth transistor and the fourth transistor of the converter circuit are different in type, and the type of the fourth transistor may be the same as the transistors of the first pixel circuits and the second pixel circuits. For example, when the fourth transistor is an N-type transistor, the fifth transistor is a P-type transistor; when the fourth transistor is a P-type transistor, the fifth transistor is an N-type transistor, which is not specifically limited in the embodiments of the present disclosure.

Figure 20:
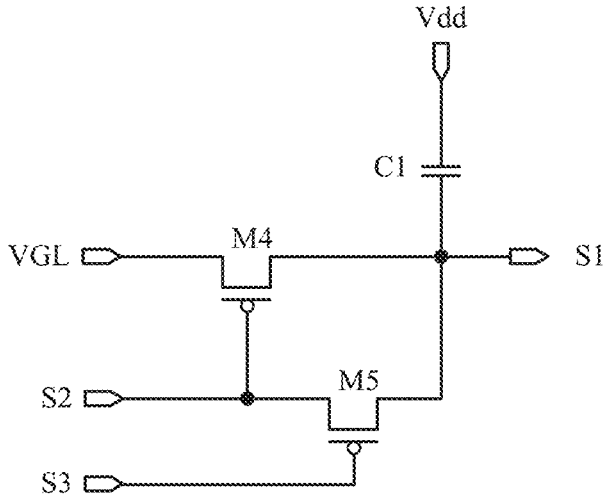
FIG. 20 is a schematic diagram of another converter circuit according to an embodiment of the present disclosure.

FIG. 20 is a structure diagram of another converter circuit according to the embodiment of the present disclosure. As shown in FIG. 17 and FIG. 20, the converter circuit includes a fourth transistor M4, a fifth transistor M5, and a first capacitor C1. A first electrode of the fourth transistor M4 is electrically connected to a low-level signal VGL of the second scanning drive circuit 53, a second electrode of the fourth transistor M4 is electrically connected to the first scanning signal line 31 through the second scanning signal line 33, and a gate electrode of the fourth transistor M4 is electrically connected to the output terminal of the second scanning drive circuit 53 through the second scanning signal line 33. A first electrode of the fifth transistor M5 is electrically connected to the output terminal of the second scanning drive circuit 53 through the second scanning signal line 33, a second electrode of the fifth transistor M5 is electrically connected to the first scanning signal line 31, and a gate electrode of the fifth transistor M5 is electrically connected to the output terminal of the second scanning drive circuit 53 through the third scanning signal line 34. A first plate of the first capacitor C1 is electrically connected to the first scanning signal line 31, and a second plate of the first capacitor C is electrically connected to a fixed potential signal line.

Figure 21:
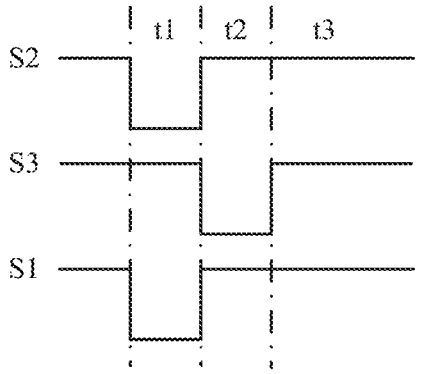
FIG. 21 is a drive timing diagram of another converter circuit according to an embodiment of the present disclosure.

Exemplarily, the first pixel circuit shown in FIG. 3 and the drive timing shown in FIG. 4 are taken as an example, the second pixel circuit shown in FIG. 13 and the drive timing shown in FIG. 14 are taken as an example. FIG. 21 is a drive timing diagram of another converter circuit according to the embodiment of the present disclosure. As shown in FIG. 3, FIG. 4, FIG. 13, FIG. 14, FIG. 17, FIG. 20 and FIG. 21, the fourth transistors M4 and the fifth transistors M5 of the converter circuits 56 are both P-type transistors. In the initialization phase t1' of the second pixel circuit 20, the second scanning signal S2 provided by the second scanning drive circuit 53 is a low-level signal, the fourth transistor M4 is switched on, the fifth transistor M5 is switched off, and the low-level signal VGL of the second scanning drive circuit 53 can be transmitted to the first scanning signal line 31 through the switched on fourth transistor M4, the low-level first scanning signal S1 is supplied to the first pixel circuit 10 in the data writing phase t1. In the threshold compensation phase t2 of the second pixel circuit 20, the second scanning signal S2 provided by the second scanning drive circuit 53 is flipped to a high-level signal, the third scanning signal S3 provided by the second scanning drive circuit 53 is a low-level signal, the fourth transistor M4 is switched oft the fifth transistor M5 is switched on, and the high-level second scanning signal S2 is transmitted to the first scanning signal line 31 through the switched on fifth transistor M5, the high-level first scanning signal S1 is supplied to the first pixel circuit 10 in the threshold compensation phase t2. When the second pixel circuit 20 is in the initialization phase t1', the first pixel circuit 10 is in the data writing phase t1. When the second pixel circuit 20 is in the threshold compensation phase t2', the first pixel circuits 10 is also in the threshold compensation phase t2. When the second pixel circuit 20 is in the light emission phase t3', the first pixel circuits 10 also is in the light emission phase 3. Thus, the organic light-emitting element of the first pixel circuit 10 and the organic light-emitting element 13' of the second pixel circuit 20 can emit light at the same time so that the display uniformity of the display panel can be improved, and the display effect of the display panel can be improved.

In one or more embodiments, the fifth transistor and the fourth transistor of the converter circuit are of the same type as the transistors of the first pixel circuit. For example, when the transistors of the first pixel circuit are P-type transistors, the fifth transistors and the fourth transistors of the converter circuit are also P-type transistors; when the transistors of the first pixel circuit are N-type transistors, the fifth transistors and the fourth transistors of the converter circuit are N-type transistors, which is not specifically limited in the embodiment of the present disclosure.

Moreover, the converter circuits may be on the same side of the display region as the second scanning drive circuits. Alternatively, the converter circuits and the second scanning drive circuits are on two opposite sides of the display region, that is, the converter circuits may be electrically connected to the output terminals of the second scanning drive circuits through the second scanning signal lines and the third scanning signal lines. The embodiment of the present disclosure does not specifically limit the specific connection modes of the converter circuits and the second scanning drive circuits.

The embodiment of the present disclosure further provides a display device. The display device includes the display panel provided by the embodiment of the present disclosure, and thus the display device also has the beneficial effect of the display panel provided by the embodiment of the present disclosure, and the display device may be understood referring to the above and is omitted hereinafter.

Figure 22:
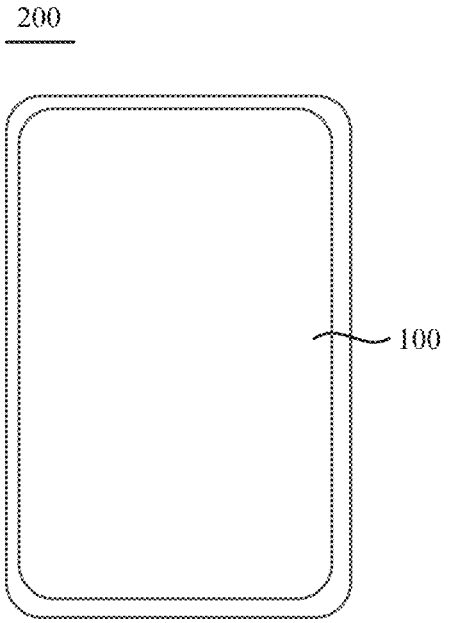
FIG. 22 is a schematic diagram of a display device according to an embodiment of the present disclosure.

Exemplarily, FIG. 22 is a structure diagram of a display device according to an embodiment of the present disclosure. As shown in FIG. 22, the display device 200 provided by the embodiment of the present disclosure includes the display panel 100 provided by the embodiments of the present disclosure. The display device 200 may be any electronic device with a display function such as a touch display screen, a cell phone, a tablet computer, a notebook computer or a television.

It is to be noted that the above are merely preferred embodiments of the present disclosure and the technical principles used therein. It will be understood by those skilled in the art that the present disclosure is not limited to the specific embodiments described herein. Those skilled in the art can make various apparent modifications, adaptations, combinations and substitutions without departing from the scope of the present disclosure. Thus, while the present disclosure has been described in detail through the above-mentioned embodiments, the present disclosure is not limited to the above-mentioned embodiments and may include more other equivalent embodiments without departing from the concept of the present disclosure. The scope of the present disclosure is determined by the scope of the appended claims.

What is claimed is:

1. A pixel circuit comprising:

a drive transistor, a storage capacitor, a data writing module, a reset module, a threshold compensation module, and an organic light-emitting element, wherein the data writing module is electrically connected to a gate electrode of the drive transistor and a first plate of the storage capacitor, and configured to write a data signal to the gate electrode of the drive transistor and the first plate of the storage capacitor in a data writing phase;

wherein the reset module is electrically connected to a second plate of the storage capacitor, and configured to write a reset signal to the second plate of the storage capacitor in the data writing phase;

wherein the threshold compensation module is electrically connected to the second plate of the storage capacitor, and configured to write a threshold compensation signal to the second plate of the storage capacitor in a threshold compensation phase to adjust a potential of the first plate of the storage capacitor to a first potential to perform threshold compensate on the drive transistor, wherein the threshold compensation signal is greater than the reset signal; and wherein the drive transistor is electrically connected to the organic light-emitting element, and configured to provide a drive current to the organic light-emitting element in a light emission phase to drive the organic light-emitting element to emit light.

2. The pixel circuit of claim 1, wherein the threshold compensation module comprises a first transistor; and a threshold voltage of the first transistor is a first threshold voltage; and wherein the threshold compensation signal comprises the first threshold voltage.

3. The pixel circuit of claim 2, wherein a threshold voltage of the drive transistor is a second threshold voltage; and wherein a difference between the first threshold voltage and the second threshold voltage is within a preset range.

4. The pixel circuit of claim 3, wherein an active layer of the first transistor comprises a first channel and an active layer of the drive transistor comprises a second channel; and wherein a distance W between the first channel and the second channel satisfies: 2.5 μm≤W≤4.5 μm.

5. The pixel circuit of claim 1, wherein the threshold compensation module comprises a first transistor, the data writing module comprises a second transistor, and the reset module comprises a third transistor;

wherein a first electrode of the first transistor is connected to an anode of the organic light-emitting element, and a second electrode of the first transistor and a gate electrode of the first transistor are both electrically connected to the second plate of the storage capacitor;

wherein a first electrode of the third transistor receives the reset signal, a second electrode of the third transistor is electrically connected to the second plate of the storage capacitor, and a gate electrode of the third transistor receives a first scanning signal;

wherein a first electrode of the second transistor receives a data signal, a second electrode of the second transistor is electrically connected to the gate electrode of the drive transistor and the first plate of the storage capacitor, and a gate electrode of the second transistor receives the first scanning signal; and wherein a first electrode of the drive transistor receives a power signal, a second electrode of the drive transistor is electrically connected to the anode of the organic light-emitting element, and a cathode of the organic light-emitting element receives a low-level signal.

6. The pixel circuit of claim 5, further comprising a connect wire, wherein the first transistor, the second transistor and the third transistor are electrically connected to the storage capacitor through different connect wires;

wherein a width L1 of the connect wire satisfies: 1.5 μm≤L1≤2.5 μm;

wherein a maximum extension length of a vertical projection of the first transistor on a reference plane is L2, wherein L2≤3 μm, wherein the reference plane is parallel to a plane of an active layer of the first transistor;

wherein a maximum extension length of a vertical projection of the second transistor on the reference plane is L3, wherein L3≤3 μm; and wherein a maximum extension length of a vertical projection of the third transistor on the reference plane is L4, wherein L4≤3 μm.

7. The pixel circuit of claim 1, wherein the first plate or the second plate of the storage capacitor also serves as the gate electrode of the drive transistor.

8. A method for driving a pixel circuit, the pixel circuit comprising a drive transistor, a storage capacitor, a data writing module, a reset module, a threshold compensation module and an organic light-emitting element, the method comprising:

in a data writing phase, writing, by the data writing module, a data signal to a gate electrode of the drive transistor and a first plate of the storage capacitor, and writing, by the reset module, a reset signal to a second plate of the storage capacitor so that a potential of the second plate of the storage capacitor is equal to a potential of the reset signal;

in a threshold compensation phase, writing, by the threshold compensation module, a threshold compensation signal to the second plate of the storage capacitor so that the potential of the second plate of the storage capacitor is equal to a potential of the threshold compensation signal and the drive transistor is threshold compensated, wherein the threshold compensation signal is greater than the reset signal; and in a light emission phase, providing, by the drive transistor, a drive current to the organic light-emitting element to drive the organic light-emitting element to emit light.

9. The method of claim 8, wherein the threshold compensation module comprises a first transistor, the data writing module comprises a second transistor, and the reset module comprises a third transistor;

wherein a first electrode of the first transistor is connected to an anode of the organic light-emitting element, and a second electrode of the first transistor and a gate electrode of the first transistor are both electrically connected to the second plate of the storage capacitor;

wherein a first electrode of the third transistor receives the reset signal, a second electrode of the third transistor is electrically connected to the second plate of the storage capacitor, and a gate electrode of the third transistor receives a first scanning signal;

wherein a first electrode of the second transistor receives the data signal, a second electrode of the second transistor is electrically connected to the gate electrode of the drive transistor and the first plate of the storage capacitor, and a gate electrode of the second transistor receives the first scanning signal;

wherein a first electrode of the drive transistor receives a power signal, a second electrode of the drive transistor is electrically connected to the anode of the organic light-emitting element, and a cathode of the organic light-emitting element receives a low-level signal;

wherein the data writing phase comprises a first phase and a second phase;

wherein in the first phase, the second transistor and the third transistor are switched on, and the data signal is written to the gate electrode of the drive transistor and the first plate of the storage capacitor through the second transistor to initialize the gate electrode of the drive transistor and a first electrode of the storage capacitor, and the reset signal is written to the second plate of the storage capacitor and the gate electrode of the first transistor through the third transistor to initialize the second plate of the storage capacitor and the gate electrode of the first transistor;

wherein in the second phase, the second transistor and the third transistor are switched on, the data signal is written to the gate electrode of the drive transistor and the first plate of the storage capacitor through the second transistor to switch on the drive transistor, and the reset signal is written to the second plate of the storage capacitor through the third transistor to enable the potential of the second plate of the storage capacitor to be equal to the potential of the reset signal; and wherein in the threshold compensation phase, the first transistor is switched on, the second transistor and the third transistor are switched off, and the first transistor writes the threshold compensation signal to the second plate of the storage capacitor so that the potential of the second plate of the storage capacitor is equal to the potential of the threshold compensation signal, wherein the threshold compensation signal is greater than the reset signal so that the potential of the first plate of the storage capacitor is raised.

10. A display panel, comprising:

a display region, and a non-display region surrounding the display region, wherein the display region comprises at least a first display region, the first display region comprises a plurality of first pixel circuits arranged in an array, and each of the plurality of first pixel circuits comprises a drive transistor, a storage capacitor, a data writing module, a reset module, a threshold compensation module and an organic light-emitting element, wherein the data writing module is electrically connected to a gate electrode of the drive transistor and a first plate of the storage capacitor, and configured to write a data signal to the gate electrode of the drive transistor and the first plate of the storage capacitor in a data writing phase;

wherein the reset module is electrically connected to a second plate of the storage capacitor, and configured to write a reset signal to the second plate of the storage capacitor in the data writing phase;

wherein the threshold compensation module is electrically connected to the second plate of the storage capacitor, and configured to write a threshold compensation signal to the second plate of the storage capacitor in a threshold compensation phase to adjust a potential of the first plate of the storage capacitor to a first potential to perform threshold compensate on the drive transistor, wherein the threshold compensation signal is greater than the reset signal; and wherein the drive transistor is electrically connected to the organic light-emitting element, and configured to provide a drive current to the organic light-emitting element in a light emission phase to drive the organic light-emitting element to emit light.

11. The display panel of claim 10, wherein the display region further comprises a plurality of first scanning signal lines, a plurality of reset signal lines, a plurality of data signal lines, and a plurality of power signal lines; and the non-display region comprises a plurality of cascaded first scanning drive circuits, a plurality of cascaded reset drive circuits and an integrated drive circuit;

wherein first pixel circuits in a same row share one of the plurality of first scanning signal lines and one of the plurality of reset signal lines; first pixel circuits in a same column share one of the plurality of data signal lines and one of the plurality of power signal lines;

wherein output terminals of the plurality of first scanning drive circuits are electrically connected to the plurality of first scanning signal lines, and configured to provide first scanning signals and transmit the first scanning signals to the plurality of first pixel circuits through the plurality of first scanning signal lines;

wherein output terminals of the plurality of reset drive circuits are electrically connected to the plurality of reset signal lines, and configured to provide reset signals and transmit the reset signals to the plurality of first pixel circuits through the plurality of reset signal lines; and wherein data signal output terminals of the integrated drive circuit are electrically connected to the plurality of data signal lines, and configured to provide data signals to the plurality of data signal lines and transmit the data signals to the plurality of first pixel circuits through the plurality of data signal lines; and power signal output terminals of the integrated drive circuit are electrically connected to the plurality of power signal lines, and configured to provide power signals to the plurality of power signal lines and transmit the power signals to the plurality of first pixel circuits through the plurality of power signal lines.

12. The display panel of claim 11, wherein the plurality of first scanning drive circuits are disposed in a first non-display region, and the plurality of reset drive circuits are disposed in a second non-display region; and wherein the first non-display region and the second non-display region are on two opposite sides of the display region.

13. The display panel of to claim 11, wherein the display region further comprises a second display region, wherein the second display region comprises a plurality of second pixel circuits arranged in an array, and a coverage area of each of the plurality of second pixel circuits is larger than a coverage area of each of the plurality of first pixel circuits.

14. The display panel of claim 13, wherein the second display region further comprises a plurality of second scanning signal lines, a plurality of third scanning signal lines, a plurality of data signal lines, and a plurality of voltage signal lines, and the non-display region further comprises a plurality of cascaded second scanning drive circuits;

wherein second pixel circuits in a same row share one of the plurality of second scanning signal lines and one of the plurality of third scanning signal lines; first pixel circuits and second pixel circuits in a same column share one of the plurality of data signal lines and one of the plurality of power signal lines;

wherein output terminals of the plurality of second scanning drive circuits are electrically connected to the plurality of second scanning signal lines and/or the plurality of third scanning signal lines; second scanning drive circuits electrically connected to the plurality of second scanning signal lines are configured to provide second scanning signals and transmit the second scanning signals to the plurality of second pixel circuits through the plurality of second scanning signal lines; second scanning drive circuits electrically connected to the plurality of third scanning signal lines are configured to provide third scanning signals and transmit the third scanning signals to the plurality of second pixel circuits through the plurality of third scanning signal lines; and wherein the integrated drive circuit is further configured to transmit the data signals to the plurality of second pixel circuits through the plurality of data signal lines.

15. The display panel of claim 14, wherein the plurality of second scanning drive circuits also serve as the plurality of first scanning drive circuits; and wherein the plurality of second scanning signal lines or the plurality of third scanning signal lines also serve as the plurality of first scanning signal lines.

16. The display panel of claim 14, wherein the non-display region further comprises a plurality of converter circuits, wherein each of the plurality of converter circuits is electrically connected between a respective one of the plurality of second scanning drive circuits and a respective one of the plurality of first scanning signal lines, and is configured to convert a low-level signal in the second scanning drive circuit to a first scanning signal in the data writing phase and convert a second scanning signal or a third scanning signal provided by the second scanning drive circuit to the first scanning signal in the threshold compensation phase.

17. The display panel of claim 16, wherein each of the plurality of converter circuits comprises a fourth transistor, a fifth transistor, and a first capacitor, wherein a first electrode of the fourth transistor is electrically connected to the low-level signal of the second scanning drive circuit, a second electrode of the fourth transistor is electrically connected to the first scanning signal line, and a gate electrode of the fourth transistor is electrically connected to an output terminal of the second scanning drive circuit through the second scanning signal line;

wherein a first electrode of the fifth transistor is electrically connected to the output terminal of the second scanning drive circuit through the second scanning signal line, and a second electrode of the fifth transistor is electrically connected to the first scanning signal line, and a gate electrode of the fifth transistor is electrically connected to the output terminal of the second scanning drive circuit through the third scanning signal line; and wherein a first plate of the first capacitor is electrically connected to the first scanning signal line, and a second plate of the first capacitor is electrically connected to a fixed potential signal line.

18. The display panel of claim 17, wherein a fixed potential of the fixed potential signal line also serves as the power signal.

19. The display panel of claim 13, wherein a number of first pixel circuits per unit area in the first display region is the same as a number of second pixel circuits per unit area in the second display region; and the first display region also serves as a sensor setting region.

20. A display device, comprising the display panel of claim 10.

* * * * *